US012264584B2

(12) United States Patent
Stephens et al.

(10) Patent No.: US 12,264,584 B2
(45) Date of Patent: Apr. 1, 2025

(54) QUICK DISCONNECT KELLY BAR SYSTEM

(71) Applicant: Bay Shore Systems Inc., Rathdrum, ID (US)

(72) Inventors: Nathan P Stephens, Post Falls, ID (US); Jonathan Andring, Cocolalla, ID (US); Benjamin John Wilson, Hayden, ID (US); Todd Eric Gorman, Worley, ID (US); Daniel James Bradburn, Medical Lake, WA (US)

(73) Assignee: BAY SHORE SYSTEMS INC., Rathdrum, ID (US)

( * ) Notice: Subject to any disclaimer, the term of this patent is extended or adjusted under 35 U.S.C. 154(b) by 259 days.

(21) Appl. No.: 17/715,793

(22) Filed: Apr. 7, 2022

(65) Prior Publication Data

US 2022/0325581 A1 Oct. 13, 2022

Related U.S. Application Data

(60) Provisional application No. 63/173,911, filed on Apr. 12, 2021.

(51) Int. Cl.

| | |
|---|---|
| ***E21B 7/02*** | (2006.01) |
| ***E02F 3/36*** | (2006.01) |
| ***E02F 3/96*** | (2006.01) |

(52) U.S. Cl.

CPC ..... *E21B 7/028* (2013.01); *E02F 3/3609* (2013.01); *E02F 3/96* (2013.01); *E21B 7/023* (2013.01); *E21B 7/024* (2013.01)

(58) Field of Classification Search

None

See application file for complete search history.

(56) References Cited

U.S. PATENT DOCUMENTS

| | | | | |
|---|---|---|---|---|
| 3,568,779 A * | 3/1971 | Cannon | ..... | E21B 7/028 173/160 |
| 3,645,343 A * | 2/1972 | Mays | ..... | E21B 15/04 173/147 |
| 3,747,697 A | 7/1973 | Russell, Jr. | | |

(Continued)

FOREIGN PATENT DOCUMENTS

| | | |
|---|---|---|
| CA | 193948 A | 11/1919 |
| CA | 2058784 C | 7/1992 |

(Continued)

OTHER PUBLICATIONS

Bay Shore, "The Lad Series Drills Get You Into Tight Spots—and out Again," Bay Shore Systems, Inc., 2022, 4 pages, retrieved by https://www.bayshoresystems.com/excavator-mounted-drills-lad-series.

(Continued)

*Primary Examiner* — Kipp C Wallace

(74) *Attorney, Agent, or Firm* — Zilka-Kotab, P.C.

(57) ABSTRACT

A quick disconnect Kelly bar system is provided. In use, a construction attachment includes a quick disconnect mounting plate for connecting the construction attachment to a hitch of a construction machine. A pivotable coupling assembly is connected to the quick disconnect mounting plate. Additionally, an extendable mast is connected to the pivotable coupling assembly at a first end of the extendable mast, and to a headblock structure at a second end of the extendable mast. Further, a Kelly-bar assembly is connected to the headblock structure.

19 Claims, 37 Drawing Sheets

(56) References Cited

U.S. PATENT DOCUMENTS

| | | | | |
|---|---|---|---|---|
| 4,148,366 | A | 4/1979 | Beckstrom et al. | |
| 4,809,788 | A * | 3/1989 | Nelson | E21B 7/02 173/28 |
| 4,863,337 | A * | 9/1989 | Ishiguro | E02F 9/2033 60/459 |
| 4,869,002 | A | 9/1989 | Glenn | |
| 5,186,266 | A * | 2/1993 | Heller | E21B 19/084 175/320 |
| 5,590,731 | A | 1/1997 | Jacobson | |
| 5,630,477 | A | 5/1997 | Minatre | |
| 6,112,834 | A * | 9/2000 | Barrett | E21B 7/02 175/162 |
| 6,872,043 | B2 | 3/2005 | Yukawa et al. | |
| 6,889,779 | B2 | 5/2005 | Skarlupka, IV et al. | |
| 7,677,337 | B2 | 3/2010 | Poeckl et al. | |
| 8,336,643 | B2 | 12/2012 | Harleman | |
| 8,646,546 | B2 * | 2/2014 | Biserna | E21B 19/086 173/147 |
| 8,807,910 | B1 | 8/2014 | Roden et al. | |
| 9,574,403 | B2 | 2/2017 | Ferrari | |
| 9,834,999 | B2 | 12/2017 | Fraley et al. | |
| 9,903,159 | B2 | 2/2018 | Bettini et al. | |
| 10,087,059 | B1 | 10/2018 | Dick et al. | |
| 10,273,754 | B2 | 4/2019 | Niemczyk | |
| 10,648,155 | B2 | 5/2020 | Wagner et al. | |
| 10,677,268 | B2 | 6/2020 | Itou et al. | |
| 10,975,624 | B2 | 4/2021 | Bamford et al. | |
| 11,008,849 | B2 | 5/2021 | Sherlock | |
| 11,174,620 | B2 | 11/2021 | Murtha | |
| 2003/0037940 | A1 | 2/2003 | Howell | |
| 2005/0126821 | A1 * | 6/2005 | Davies | E21B 7/028 175/244 |
| 2006/0180325 | A1 * | 8/2006 | Stoetzer | E21B 7/02 172/452 |
| 2008/0110657 | A1 * | 5/2008 | Gunnarson | E21B 7/02 173/184 |
| 2008/0217037 | A1 * | 9/2008 | Howell | E21B 7/027 173/28 |
| 2009/0321134 | A1 | 12/2009 | Matthews et al. | |
| 2010/0319222 | A1 * | 12/2010 | Lanzl | E02F 9/006 37/195 |
| 2011/0214918 | A1 | 9/2011 | Keck et al. | |
| 2013/0341124 | A1 * | 12/2013 | Robinson | B66F 9/075 175/122 |
| 2014/0251697 | A1 * | 9/2014 | Jones | E21B 7/027 175/382 |
| 2016/0222733 | A1 | 8/2016 | Hansen | |
| 2020/0072032 | A1 | 3/2020 | Sherlock | |
| 2020/0109037 | A1 | 4/2020 | Pesaresi et al. | |
| 2021/0002968 | A1 | 1/2021 | Branson et al. | |
| 2021/0123217 | A1 | 4/2021 | Okumura et al. | |
| 2021/0277720 | A1 * | 9/2021 | Watson | E21B 7/021 |

FOREIGN PATENT DOCUMENTS

| | | | |
|---|---|---|---|
| EP | 0741209 | A2 | 11/1996 |
| EP | 1607363 | A2 | 12/2005 |
| EP | 1830006 | A1 | 9/2007 |
| WO | 2021182421 | A1 | 9/2021 |

OTHER PUBLICATIONS

Sunghyun, "Products—SRD-5000," Sunghyun Eng, Inc., 2020, 11 pages, retrieved from http://web.archive.org/web/20201125081709/http://www.sunghyuneng.com/theme/sheng/en/product.php.

Digga, "Construction Grade Machinery Attachments, " Digga, 2022, 2 pages, retrieved from https://www.diggausa.com/#prettyPhoto.

Partial Examination Report from European Application No. 21198684.9, dated Mar. 16, 2022.

International Search Report and Written Opinion from PCT Application No. PCT/US22/23908, dated Jul. 27, 2022.

* cited by examiner

2700

QUICK DISCONNECT KELLY BAR SYSTEM

CROSS REFERENCE TO RELATED APPLICATIONS

This application claims priority to and the benefit of U.S. Provisional Patent Application Ser. No. 63/173,911 filed Apr. 12, 2021, entitled "Construction Equipment and Adapter Assemblies", the entirety of which is incorporated by reference herein.

FIELD OF THE INVENTION

The present invention relates to construction equipment, and more particularly to a quick disconnect Kelly bar system.

BACKGROUND

Conventionally, construction machines are dedicated to a particular function (e.g. digging, hydraulic rotary drilling, etc.). These construction machines are typically substantial in size and weight. Additionally, any attachments to such construction machines are often a permanent addition to the construction machine, and/or may additionally be substantial in size (reducing portability, etc.). Further, smaller construction machines (e.g. skid steer, lighter excavator, etc.) often cannot support a heavy attachment. As such, the size and expense of conventional dedicated construction machines present obstacles to digging and boring more ubiquitously.

As such, there is thus a need for addressing these and/or other issues associated with the prior art.

SUMMARY

A quick disconnect Kelly bar system is provided. In use, a construction attachment includes a quick disconnect mounting plate for connecting the construction attachment to a hitch of a construction machine. A pivotable coupling assembly is connected to the quick disconnect mounting plate. Additionally, an extendable mast is connected to the pivotable coupling assembly at a first end of the extendable mast, and to a headblock structure at a second end of the extendable mast. Further, a Kelly-bar assembly is connected to the headblock structure.

In one embodiment, the construction machine includes a non-dedicated construction rig. Additionally, the construction attachment may be portable and can be removed from the construction machine. The construction attachment may not be integrated into the construction machine, or the construction attachment may not be a permanent attachment to the construction machine. Further, the quick disconnect mounting plate may include a locking mechanism to lock the construction attachment to the construction machine.

In one embodiment, a function of the construction attachment may be powered by the construction machine. Additionally, a control of the construction attachment may occur independent of the construction machine. Further, a control of the construction attachment may occur by at least one of a wired or a wireless connection.

Still yet, in one embodiment, an earth penetrating device or an auger may be connected to the Kelly-bar assembly. Additionally, the extendable mast and the Kelly-bar assembly may be configured for transport by aligning the extendable mast and the Kelly-bar assembly in a substantially horizontal relationship in relation to ground.

In one embodiment, the quick disconnect mounting plate includes one or more sleeves located on at lateral edge of the quick disconnect mounting plate. Additionally, the one or more sleeves may be configured to slidably engage one or more stabilizers, wherein the one or more stabilizers may be controlled by at least one hydraulic piston attached to the quick disconnect mounting plate or mechanically attached to the quick disconnect mounting plate. In the context of the present description, the one or more stabilizers may be analogous to an outrigger.

In addition, in one embodiment, the Kelly-bar assembly may be connected to an auger, and may be extended at an angle perpendicular to the substrate surface, and/or may be extended at an angle other than perpendicular to the substrate surface. In one embodiment, the pivotable coupling may be operable to pivot the extendable mast, the headblock, and the Kelly-bar assembly between a horizontal position and a vertical position.

In one embodiment, the extendable mast may be operable to swing between a first position wherein the extendable mast and the Kelly-bar assembly face the quick disconnect mounting plate, and a second position wherein the extendable mast is situated between the Kelly-bar assembly and the quick disconnect mounting plate. Further, in one embodiment, a Kelly winch may be attached to the extendable mast, where the Kelly winch includes a winch drum for wire rope, the wire rope extending from the Kelly winch over the headblock structure and connected to the Kelly-bar assembly.

Moreover, in one embodiment, at least one first piston may be attached to a first segment of the extendable mast and a second segment of the extendable mast, where the at least one first piston may be used to control a height of the extendable mast. Additionally, at least one second piston may be attached to the quick disconnect mounting plate and to the first segment of the extendable mast, where the at least one second piston may be used to control an angle of the extendable mast. Further, one or more motors may be attached to the headblock structure, where the one or more motors are used to control pivoting of the Kelly-bar assembly away from the extendable mast.

In use, a method may include attaching, via a quick disconnect mounting plate, a construction attachment to a hitch of a construction machine, where the construction attachment includes: a pivotable coupling assembly connected to the quick disconnect mounting plate, an extendable mast connected to the pivotable coupling assembly at a first end of the extendable mast, and to a headblock structure at a second end of the extendable mast, and a Kelly-bar assembly connected to the headblock structure. Additionally, function of the construction attachment is controlled via a controller independent of the construction machine.

In one embodiment, auxiliary pressure and auxiliary power lines may be connected from the construction machine to the construction attachment. Further, placement of the construction attachment may be controlled via the construction machine.

DETAILED DESCRIPTION

Figure 1:
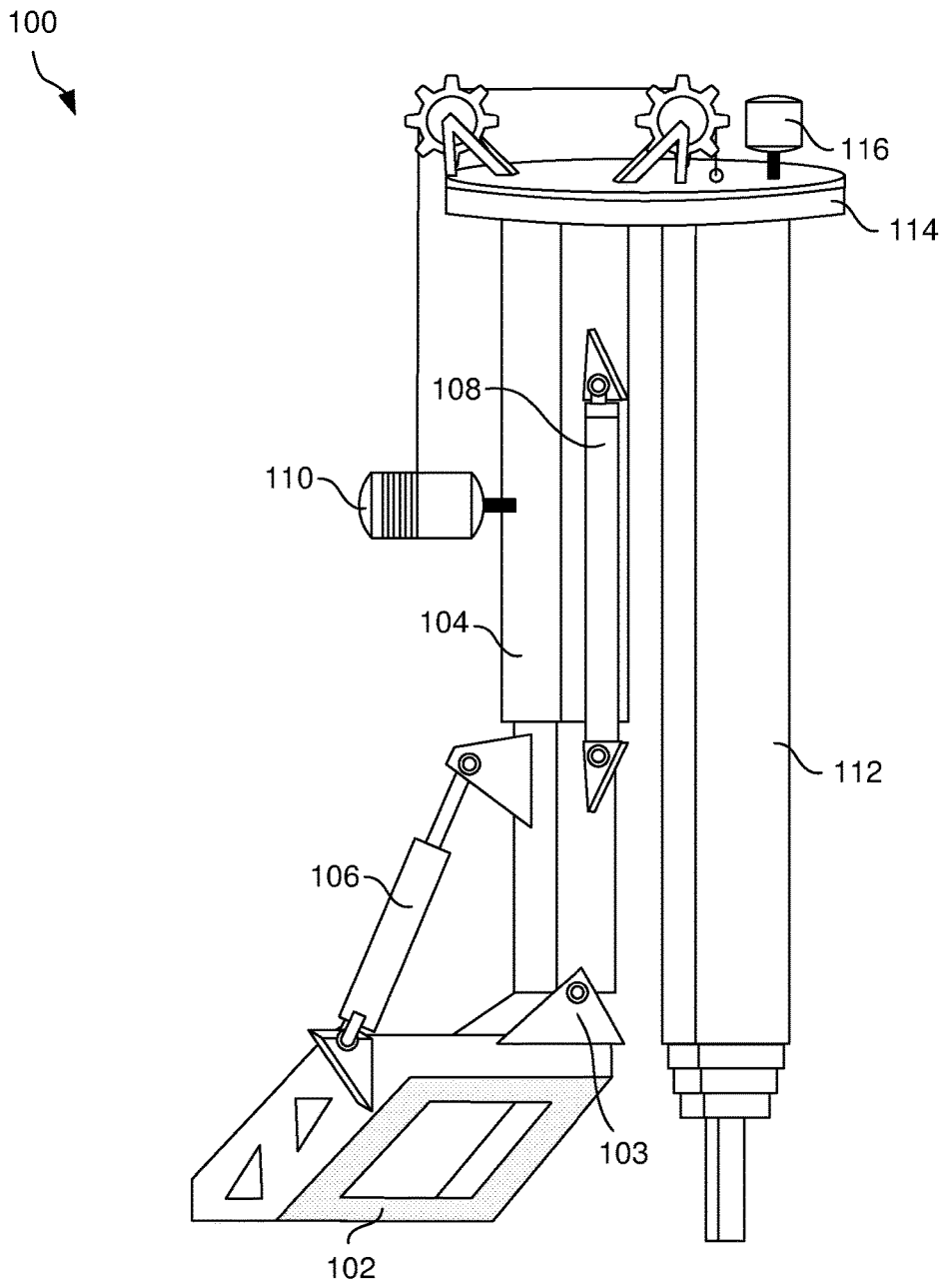
FIG. 1 is a depiction of a quick disconnect Kelly bar system, in accordance with one embodiment.

FIG. 1 illustrates a depiction 100 of a quick disconnect Kelly bar system, in accordance with one embodiment.

As shown, the depiction 100 includes a quick disconnect 102, a pivotable coupling 103, a mast 104, a first piston 106, a second piston 108, a Kelly winch 110, a Kelly bar assembly 112, a headblock 114, and one or more motors 116. Within the context of the present description, the depiction 100 may be referred to as a construction attachment.

In use, a construction attachment (such as the depiction 100) includes a quick disconnect 102 mounting plate for connecting the construction attachment to a hitch of a construction machine. A pivotable coupling 103 assembly may be connected to the quick disconnect 102 mounting plate. Additionally, the mast 104 (which may be extendable) may be connected to the pivotable coupling 103 assembly at a first end of the extendable mast, and to a headblock 114 structure at a second end of the extendable mast. Further, a Kelly-bar assembly 112 may be connected to the headblock 114 structure. In one embodiment, the pivotable coupling 103 may include a swing assembly system (not shown) to swing (i.e. rotate) the mast 104, the headblock 114, and the Kelly-bar assembly 112. For example, the swing assembly system may be used to rotate the mast 104, the headblock 114, and the Kelly-bar assembly 112 from a first position (such as, e.g., where the mast 104 and the Kelly-bar assembly 112 are parallel to the quick disconnect 102) and a second position (such as, e.g., where the mast 104 is situated between the Kelly-bar assembly 112 and the quick disconnect 102).

In the context of the present description, the quick disconnect 102 refers to any coupler attachment for a construction machine. For example, for skid steers, a quick disconnect may be compatible with (but not be limited by) a universal skid steer hitch, a skid quick hitch coupler, and/or any coupler or configuration that allows for effective attachment for a skid steer. For excavators, a quick disconnect may be compatible with (but not be limited by) a x-change quick clamp, quick hitch, quick coupler, wedgebolt coupler, pin-grabber coupler, and/or any coupler or configuration that allows for effective attachment for an excavator. It is to be appreciated that construction machine manufacturers often have manufacturer specific couplers (e.g. such as for excavators). Thus, within the context of the present description, the quick disconnect includes both universal and manufacturer-specific couplers, where the quick disconnect allows for connecting or disconnecting an attachment from a construction machine.

Additionally, although the examples provided herein relate primarily to skid steers and excavators, it is recognized that the quick disconnect may relate to any type of construction machine (e.g. bobcat, truck, backhoe, bulldozer, forklift, skid loader, excavator, trencher, etc.) which has a quick disconnect coupling. As discussed herein, in one embodiment, a limiting consideration to the type of construction machine used may be a minimum weight of the construction machine.

In one embodiment, the quick disconnect 102 includes any coupling system that is not permanently affixed to the construction machine. For example, in contrast, a dedicated construction machine may have attachments and/or additions added to the construction machine which are affixed directly (welded to, mounted to, etc.) to the construction machine, causing the construction machine to be a dedicated machine thereafter relating to the attachment and/or additions added to the construction machine.

As such, the quick disconnect 102 may be of specific dimensions and/or configuration such that it enables attachment to a construction machine.

In one embodiment, the construction machine may include a non-dedicated construction rig. Additionally, the construction attachment may be portable and may be removed from the construction machine. Moreover, in one embodiment, the construction attachment may not be integrated into the construction machine, or the construction attachment may not be a permanent attachment to the construction machine. Further, the quick disconnect mounting plate may include a locking mechanism to lock the construction attachment to the construction machine.

Additionally, in one embodiment, the mast 104 may be extendable. Thus, the mast 104 may be comprised of two (or any number of) sections which may be lengthened via the piston 108. Engaging the piston 108 may cause a first section of the mast 104 to extend from a second section of the mast 104. In one embodiment, the mast 104 may be retracted for purposes of providing a crowd to engage the auger in the ground. It is to be appreciated that the type of Kelly-bar assembly used (e.g. round, square, etc.) may control the function of how the mast is used (e.g. to friction lock, etc.) and extended/retracted.

Moreover, in one embodiment, at least one first piston (such as the piston 108) may be attached to a first segment of the extendable mast 104 and a second segment of the extendable mast 104, where the at least one first piston (such as the piston 108) may be used to control a height of the extendable mast 104. Additionally, at least one second piston (such as the piston 106) may be attached to the quick disconnect 102 mounting plate and to the first segment of the extendable mast 104, where the at least one second piston (such as the piston 106) may be used to control an angle of the extendable mast 104. Additionally, as used herein, a piston may be controlled by one or more of an engine, a pneumatic, a hydraulic, a compressor, a mechanical assembly, etc.

The pivotable coupling 103, in one embodiment, may be a pivot joint, a swivel joint, and/or any type of coupling such that the mast 104 can pivot with respect to the quick disconnect 102. In this manner, the mast 104 may be rotated in a single axis of the pivotable coupling 103 based on the piston 106. Engaging the piston 106 can cause the mast 104 to rotate to a horizontal position (with respect to the ground) or to a vertical position (with respect to the ground). In one embodiment, having the mast 104 in a horizontal position may allow for easier transport, and having the mast 104 in a vertical position may allow for drilling, engagement of the auger, etc. As such, the extendable mast and the Kelly-bar assembly may be configured for transport by aligning the extendable mast and the Kelly-bar assembly in a substantially horizontal relationship in relation to ground.

In addition, in one embodiment, the Kelly-bar assembly 112 may be connected to an auger, and may be extended at an angle perpendicular to the substrate surface, and/or may be extended at an angle other than perpendicular to the substrate surface. In one embodiment, the pivotable coupling 103 may be operable to pivot the extendable mast 104, the headblock 114, and the Kelly-bar assembly 112 between a horizontal position and a vertical position. In various embodiments, the auger that may be attached to the Kelly-bar assembly 112 may include a substrate removing tooling, which may include, but be not limited to, an earth auger, a rock auger, a core barrel, etc.

In one embodiment, the extendable mast 104 may be operable to swing between a first position wherein the extendable mast 104 and the Kelly-bar assembly 112 face the quick disconnect mounting plate, and a second position wherein the extendable mast 104 is situated between the Kelly-bar assembly 112 and the quick disconnect 102 mounting plate. Further, in one embodiment, a Kelly winch 110 may be attached to the extendable mast 104, where the Kelly winch includes a winch drum for wire rope, the wire rope extending from the Kelly winch 110 over the headblock 114 and connected to the Kelly-bar assembly 112.

The Kelly winch 110 may be used to engage and control the Kelly bar assembly 112. As an example, engaging the Kelly winch 110 may cause the Kelly bar assembly 112 to be raised or lowered. Lowering the Kelly bar assembly 112 may be a function of increasing the cable released via the Kelly winch 110, which in turn, based on gravity, may cause the Kelly bar assembly 112 to extend. Within the context of the present description, the Kelly bar assembly includes any telescopic bar including but not limited to grief joints, Kelly joints, Kelly stems, interlocking bars, etc. The Kelly bar assembly may be of any shape or sides (e.g. three, four, six, eight-sided, etc.).

In one embodiment, the headblock 114 may be used to rotate Kelly bar assembly 112. In one embodiment, the headblock 114 may be rigidly fixed to the mast 104. Further, the headblock 114 may be used to affix one or more motors 116. Such one or more motors 116 may be used to control rotation of the Kelly bar assembly 112, and/or an attachment (not shown in FIG. 1 but shown as an auger in, e.g., FIGS. 2, 14-15, 23-25, and 30-31) to the Kelly bar assembly. Thus, the one or more motors 116 may be used to rotate an auger (as an example, or any other attachment) attached to the Kelly bar assembly 112. In one embodiment, an earth penetrating device or an auger may be connected to the Kelly-bar assembly.

Further, in one embodiment, one or more motors 116 may be attached to the headblock 114, where the one or more motors 116 are used to control the rotation of the Kelly-bar assembly 112.

In one embodiment, a function of the construction attachment may be powered by the construction machine. For example, electrical needs of the construction attachment may be provided by a construction machine (via battery source, via the engine, etc.). Additionally, a control of the construction attachment may occur independent of the construction machine. For example, once the construction attachment is attached to a construction machine, the construction machine may be used to position and/or move the construction attachment. However, once at a desired location, function of the construction attachment may occur independent of the construction machine via a separate controller (not associated with the construction machine). Thus, control of the construction attachment may occur may a controller specific to the construction attachment. In one embodiment, control of the construction attachment (via the controller) may occur by at least one of a wired or a wireless connection.

In one embodiment, the quick disconnect 102 mounting plate includes one or more sleeves (not shown in FIG. 1) located on at lateral edge of the quick disconnect mounting plate. Additionally, the one or more sleeves may be configured to slidably engage one or more stabilizers (who, e.g. in FIG. 2 as one or more stabilizers 206), wherein the one or more stabilizers may be controlled by pistons attached to the quick disconnect 102 mounting plate. In the context of the present description, the one or more stabilizers may be analogous to an outrigger.

More illustrative information will now be set forth regarding various optional architectures and uses in which the foregoing method may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
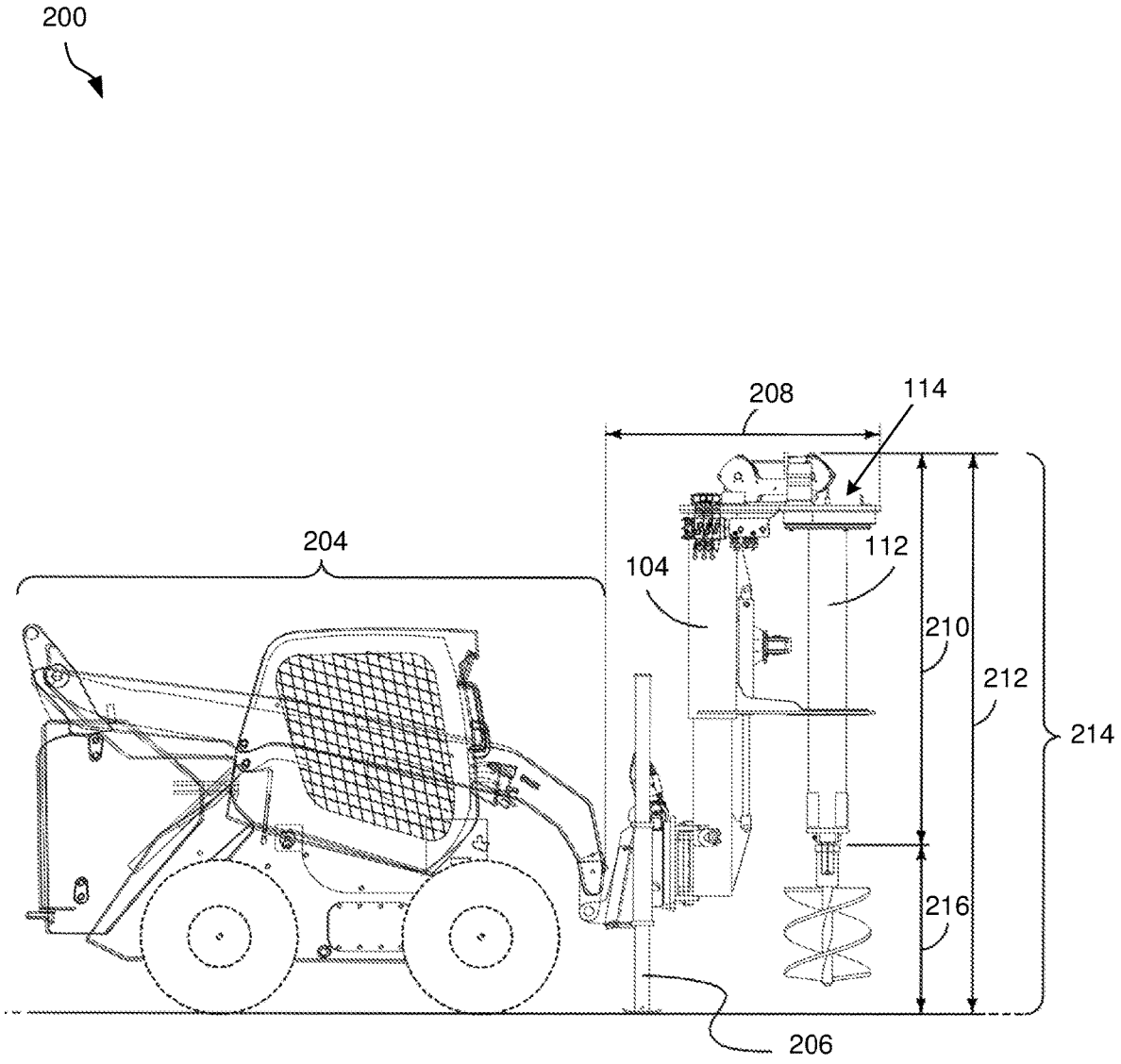
FIG. 2 illustrates a depiction of skid-steer loader and the quick disconnect Kelly bar system, in accordance with one embodiment.

FIG. 2 illustrates a depiction 200 of skid-steer loader and the quick disconnect Kelly bar system, in accordance with one embodiment. As an option, the depiction 200 may be implemented in the context of any one or more of the embodiments set forth in any previous and/or subsequent figure(s) and/or description thereof. Of course, however, the depiction 200 may be implemented in the context of any desired environment. Further, the aforementioned definitions may equally apply to the description below.

As shown, depiction 200 includes a skid steer loader 204 operably coupled to an attachment assembly 214. In one embodiment, the attachment assembly 214 may be analogous to, or derivative from depiction 100 (also used herein as the construction attachment). Additionally, in another embodiment, the attachment assembly 214 may be configured to drill holes in substrate such as earth, for example, utilizing an auger (or any other earth penetrating attachment). The attachment assembly 214 may include a vertically sliding mast 104 extending to a headblock structure 114 which extends to a set of extendible Kelly bars (Kelly bar assembly 112). Additionally, the attachment assembly 214 may include, in one specific embodiment, one or more stabilizers. The number of stabilizers needed may depend on the construction machine being used. For example, a skid steer may require two stabilizers (for support and stability), while an excavator may require one stabilizer (for support and stability), whereas a larger construction machine (with greater weight) may not require any stabilizers.

The stabilizers 206 may be extended during operation attachment assembly 214. For example, the stabilizers may be used during boring or digging operations, during transport, and/or for storage of the attachment assembly when detached from a construction machine (such as the skid steer 204).

In one specific embodiment, the distance 208 from the front of the construction machine boom (such as a skid steer boom) to the far edge of the assembly may be less than five feet (or about 4'-9"). The distance 210 between the uppermost portion of the construction attachment and the end the Kelly bar assembly when recoiled may be less than 7 feet (or about 6'-11"). The distance 212 between the uppermost portion of the construction attachment and a supporting surface may be less than 10 feet (or about 9'-11"). The distance 216 between the end of a recoiled Kelly bar assembly and the surface may be less than 3 feet.

It is to be appreciated that although the skid steer 204 is shown, any construction machine with a quick disconnect may be used in place of the skid steer 204.

Figure 3:
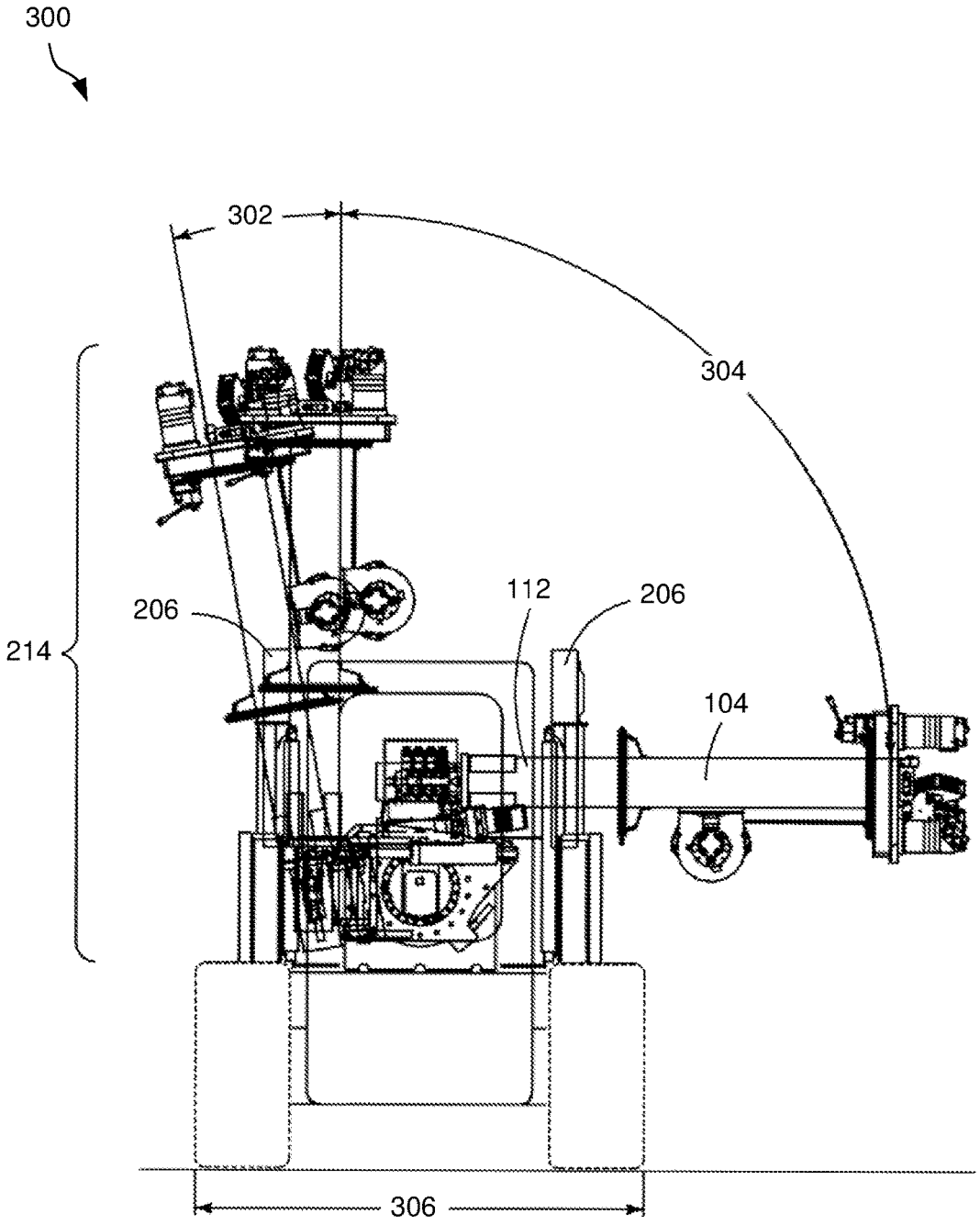
FIG. 3 illustrates another view of the skid-steer loader and the quick disconnect Kelly bar system, in accordance with one embodiment.

FIG. 3 illustrates another view 300 of the skid-steer loader and the quick disconnect Kelly bar system, in accordance with one embodiment. As an option, the another view 300 may be implemented in the context of any one or more of the embodiments set forth in any previous and/or subsequent figure(s) and/or description thereof. Of course, however, the another view 300 may be implemented in the context of any desired environment. Further, the aforementioned definitions may equally apply to the description below.

As such, the attachment assembly 214, particularly the mast 104 and the Kelly bar assembly 112, may be configured to rotate along an axis aligned normal to their extended axis. Additionally, the mast 104 and the Kelly bar assembly 112 may be rotated between a horizontal position (typically used for storage or travel) and a vertical position (typically used for augering/boring).

In one embodiment, a side tilt 302 can be as much as 90 degrees, with alternating side tilt 304 being as much as 90 degrees. In accordance with example implementations, the side tilt 302 can be −90 degrees and the tilt 304 can be +90 degrees. An example distance 306 for wheel support base can be 6 feet or less. Utilizing the attachment assembly 214 at a tilt may be useful when providing holes that are offset from perpendicular to the surface of the substrate being augered/bored. Of course, it is to be understood that the side tilt 302 and the alternating side tilt 304 may be controlled (per degree) as needed. In one embodiment, a use of the attachment assembly 214 may include having the mast 104 and the Kelly bar assembly 112 at a horizontal (or near horizontal) angle, and then rotated (such as alternating side tilt 304) 90 degrees to a vertical (or near vertical) angle.

Figure 4:
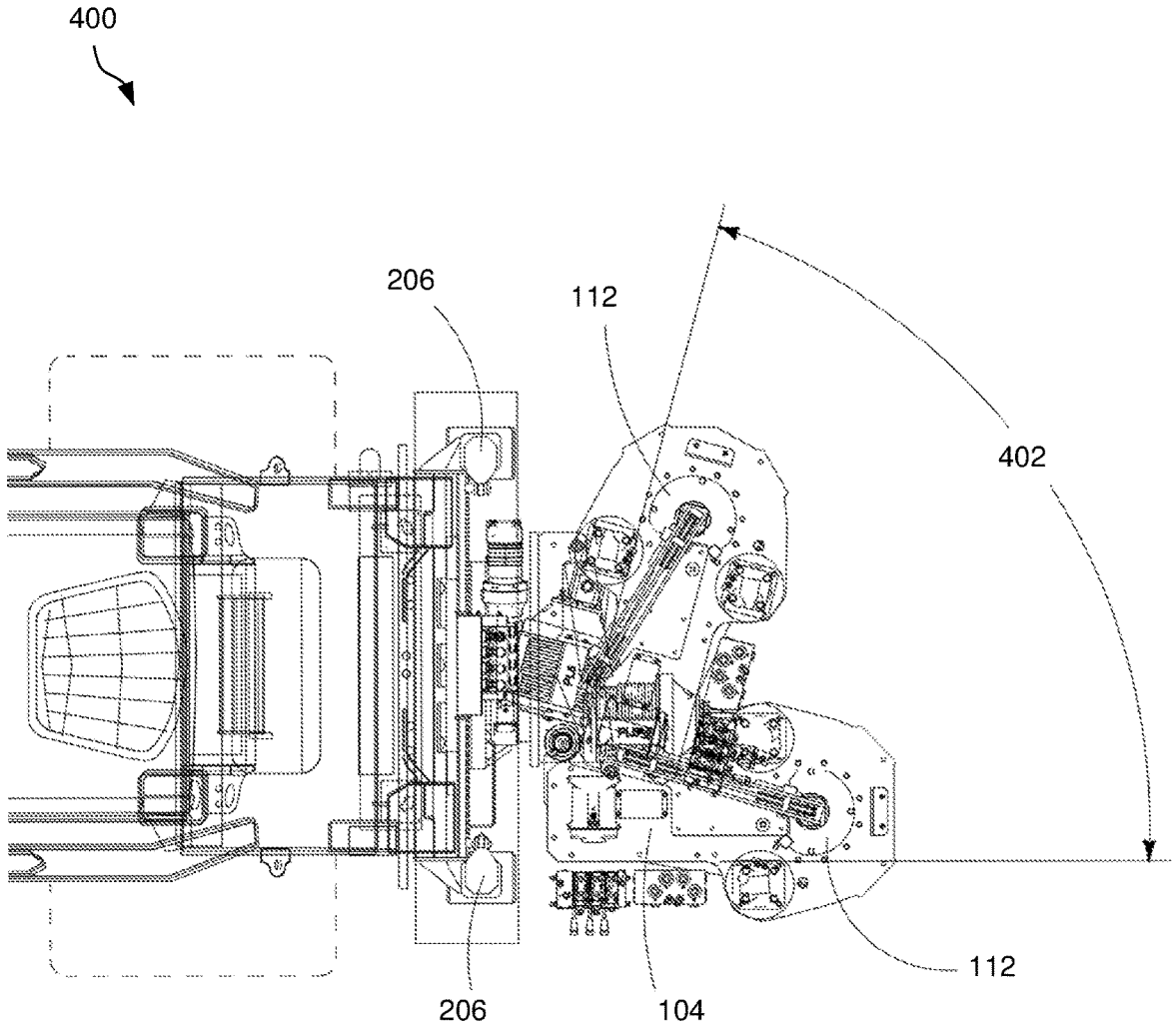
FIG. 4 illustrates another view of the skid-steer loader and the quick disconnect Kelly bar system, in accordance with one embodiment.

FIG. 4 illustrates another view 400 of the skid-steer loader and the quick disconnect Kelly bar system, in accordance with one embodiment. As an option, the another view 400 may be implemented in the context of any one or more of the embodiments set forth in any previous and/or subsequent figure(s) and/or description thereof. Of course, however, the another view 400 may be implemented in the context of any desired environment. Further, the aforementioned definitions may equally apply to the description below.

As shown, the mast 104 and the Kelly bar assembly 112 can be configured to rotate or hinge upon the axis of the boom, allowing for the rotation of the Kelly bar assembly 112 in relation to the mast 104. For example, angle 402 is shown at about 75 degrees. However, the angle 402 can rotate as much as 180 degrees. This hinged configuration in relation to the attachment frame (associated with the quick disconnect 102) may allow for the mast 104 to be between the quick disconnect 102 and the Kelly bar assembly 112 in one configuration (typically when actively augering/boring), and another where the mast 104 and the Kelly bar assembly 112 face the quick disconnect 102 attachment frame (typically in storage or transport).

Figure 5:
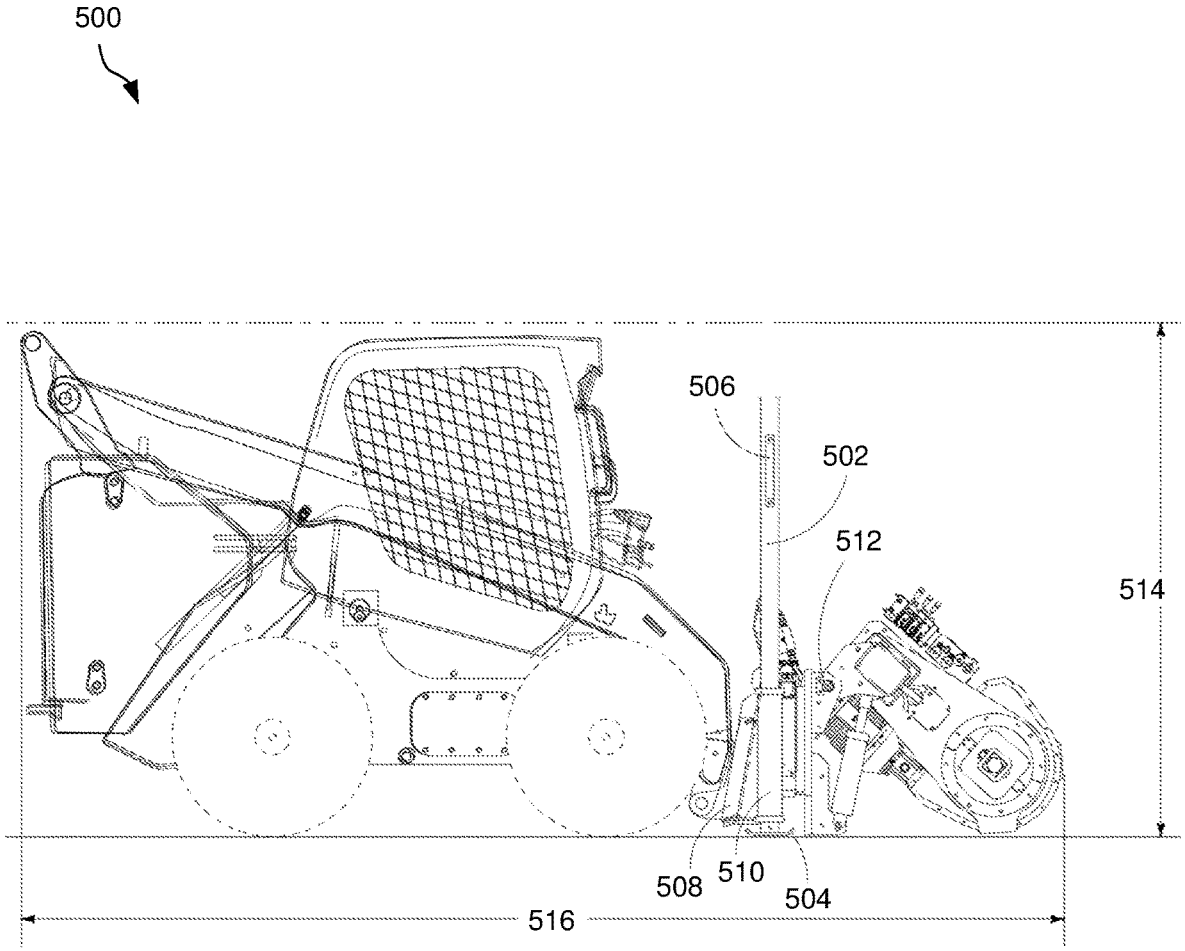
FIG. 5 illustrates another view of the skid-steer loader and the quick disconnect Kelly bar system, in accordance with one embodiment.

FIG. 5 illustrates another view 500 of the skid-steer loader and the quick disconnect Kelly bar system, in accordance with one embodiment. As an option, the another view 500 may be implemented in the context of any one or more of the embodiments set forth in any previous and/or subsequent figure(s) and/or description thereof. Of course, however, the another view 500 may be implemented in the context of any desired environment. Further, the aforementioned definitions may equally apply to the description below.

Figure 6:
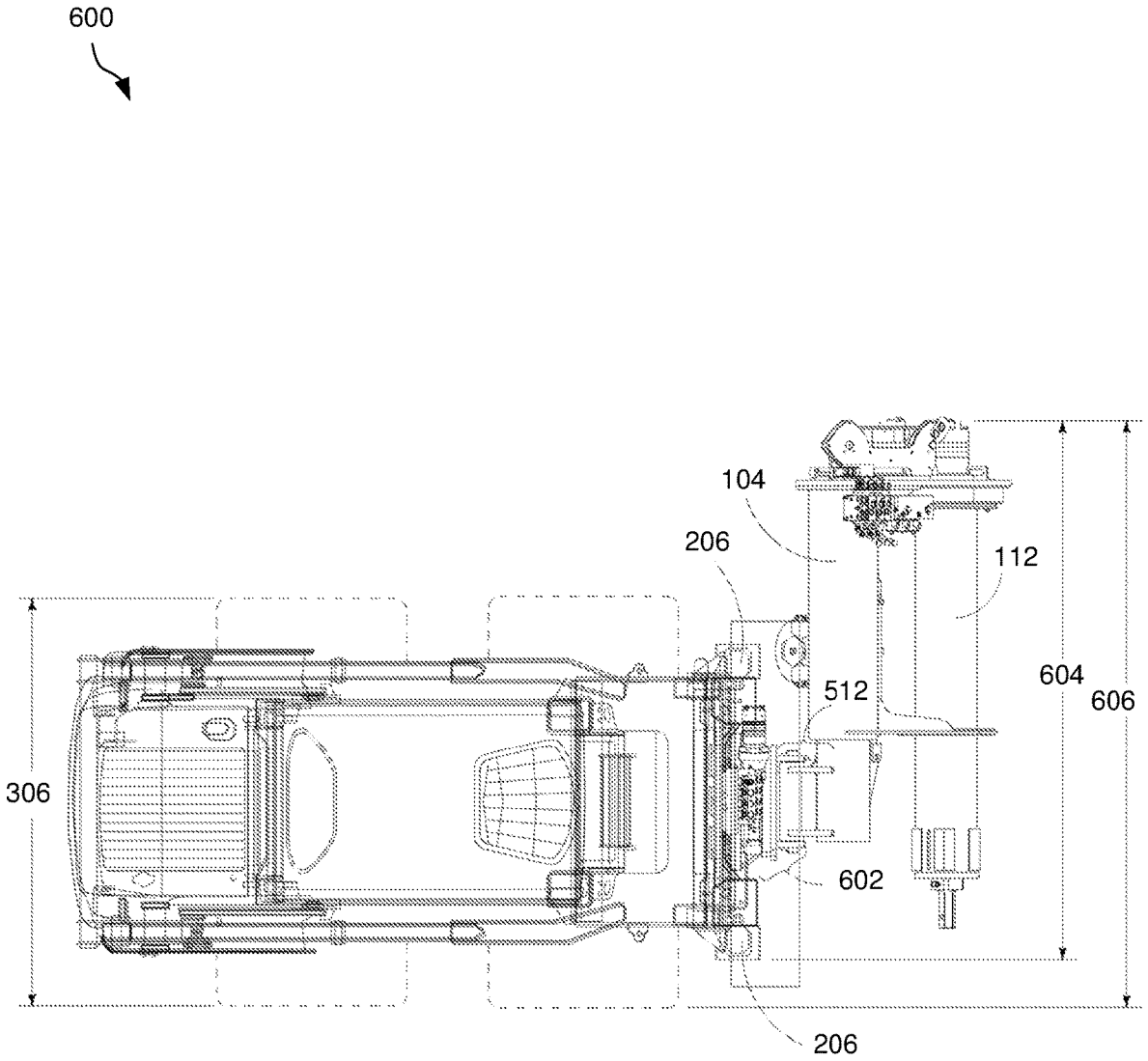
FIG. 6 illustrates a top view of the skid-steer loader and the quick disconnect Kelly bar system, in accordance with one embodiment.

As shown, the mast 104 and the Kelly bar assembly 112 may be configured for transport by aligning the mast 104 and the Kelly bar assembly 112 in a substantially horizontal relationship in relation to the skid steer (also shown in an alternative view in FIG. 6, from a top level). This can provide for transport of the construction attachment (including the mast, Kelly bar assembly, etc.) between job sites or as desired. It is to be understood that, again, any construction machine may be used and/or displayed in place of the skid steer. Additionally, the number of stabilizers 206 provided may be a function of the construction machine which is connected to the quick disconnect 102.

Further, as shown, an attachment frame 508 (which may contain also the quick disconnect 102) may include one or more stabilizers 502 within sleeves 510 on the lateral edges of the attachment frame 508. The one or more stabilizers 502 may include a stabilizer foot 504. Additionally, the one or more stabilizers may include one or more handles 506. In one embodiment, hinge portions 512 may be configured to engage complimentary hinge portions of the mast 104.

In one embodiment, an overall height 514 of a construction machine and the construction attachment can be less than 7 feet and an overall length 516 of a construction machine and the construction attachment can be less than a little over 14 feet.

FIG. 6 illustrates a top view 600 of the skid-steer loader and the quick disconnect Kelly bar system, in accordance with one embodiment. As an option, the top view 600 may be implemented in the context of any one or more of the embodiments set forth in any previous and/or subsequent figure(s) and/or description thereof. Of course, however, the top view 600 may be implemented in the context of any desired environment. Further, the aforementioned definitions may equally apply to the description below.

As shown, the top view 600 shows the distance 306 for wheel support base, the one or more stabilizers 206, the mast 104, the Kelly bar assembly 112, the hinge coupling 512, and a pivotable coupling assembly 602. In one embodiment, the pivotable coupling assembly may provide for the pivotable engagement of the construction attachment (which comprises the mast 104, the Kelly bar assembly 112, and the headblock 114, etc.). For example, the pivotable coupling assembly 602 may be used to pivot the construction attachment assembly from a horizontal position to a vertical position (or any angle between or exceeding, etc.).

Also, a distance 604 from the top of the construction attachment to the far outrigger can be less than 8 feet, and a distance 606 from the top of the construction attachment to the far perimeter of the wheel can be less than 8'6" to provide for transport (including without permit).

Figure 7:
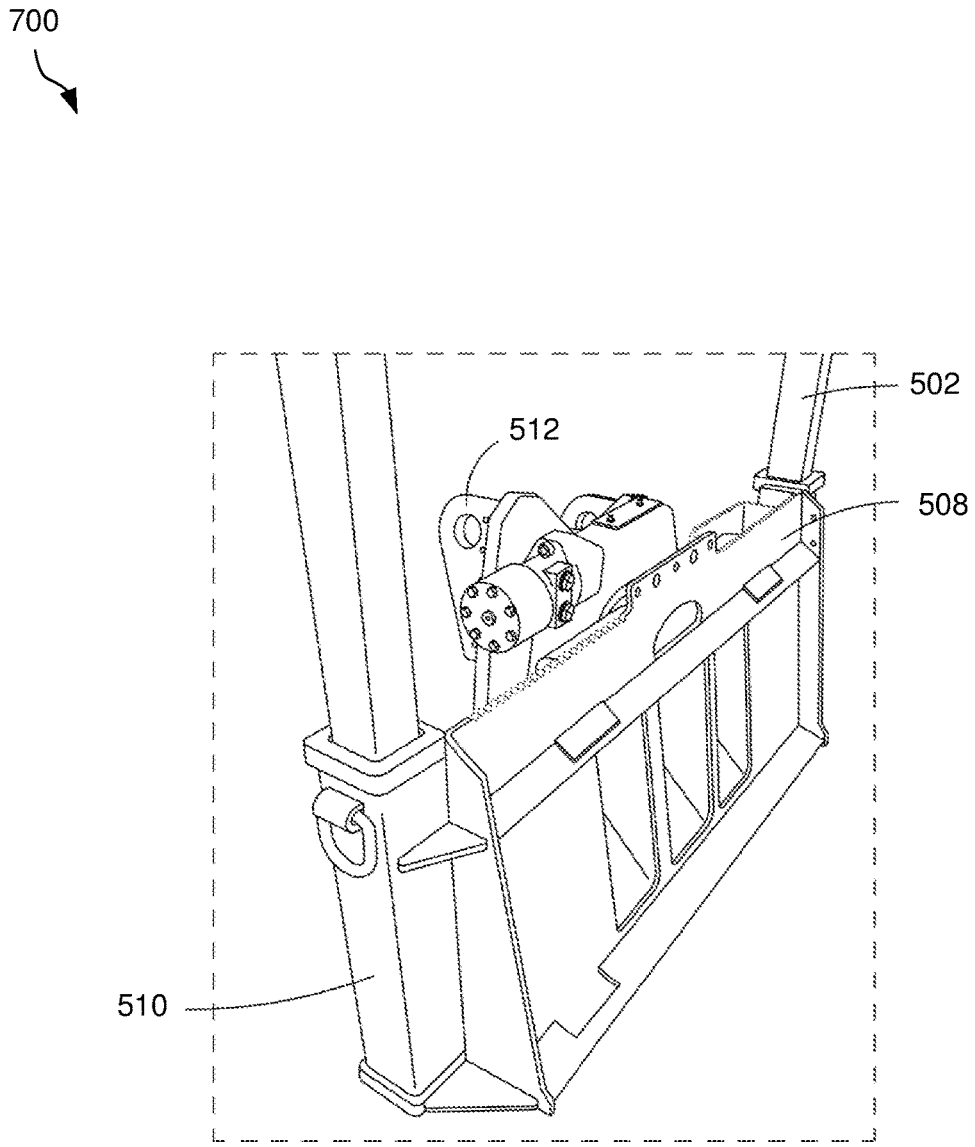
FIG. 7 illustrates a detailed view of an attachment frame of the quick disconnect Kelly bar system, in accordance with one embodiment.

FIG. 7 illustrates a detailed view 700 of an attachment frame of the quick disconnect Kelly bar system, in accordance with one embodiment. As an option, the detailed view 700 may be implemented in the context of any one or more of the embodiments set forth in any previous and/or subsequent figure(s) and/or description thereof. Of course, however, the detailed view 700 may be implemented in the context of any desired environment. Further, the aforementioned definitions may equally apply to the description below.

As shown, the detailed view 700 includes the one or more stabilizers 502 within the sleeves 510. Further, the attachment frame 508 may have slots for a quick disconnect. For example, the attachment frame 508 shows a universal quick disconnect for a skid steer. It is to be appreciated that the attachment frame 508 may be modified to account for any quick disconnect. Further, although the detailed view 700 shows two stabilizers (the one or more stabilizers 502), it is to be understood that any number (or none) of stabilizers may be used, depending on the construction machine to which the attachment frame is connected. Further, the hinge portions 512 may be configured to attach to the mast 104 (and/or to a complimentary hinge portion of the mast 104).

Figure 8:
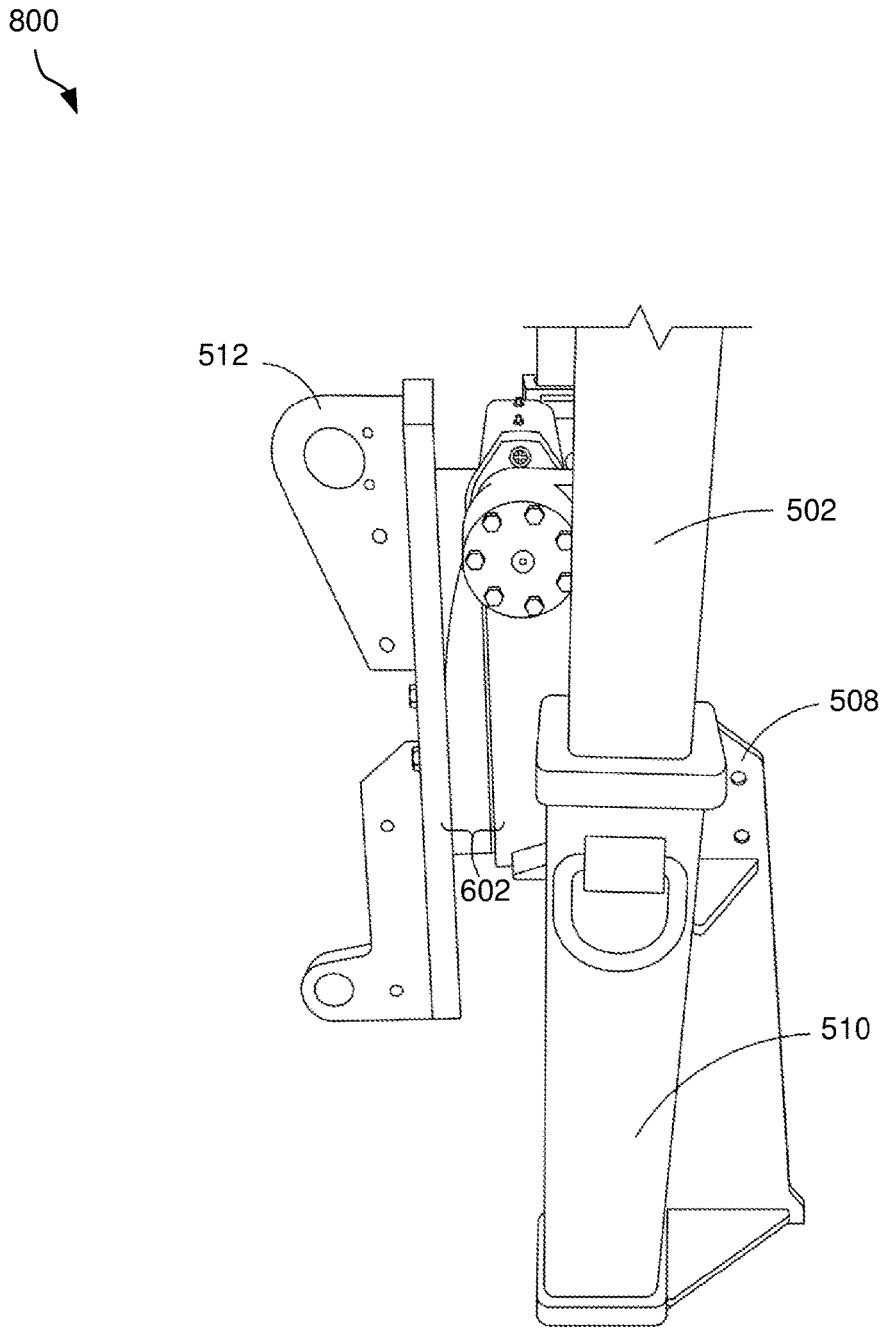
FIG. 8 illustrates another detailed view of the attachment frame of the quick disconnect Kelly bar system, in accordance with one embodiment.

FIG. 8 illustrates another detailed view 800 of the attachment frame of the quick disconnect Kelly bar system, in accordance with one embodiment. As an option, another detailed view 800 may be implemented in the context of any one or more of the embodiments set forth in any previous and/or subsequent figure(s) and/or description thereof. Of course, however, the another detailed view 800 may be implemented in the context of any desired environment. Further, the aforementioned definitions may equally apply to the description below.

As shown, the detailed view 800 includes the one or more stabilizers 502, the attachment frame 508, the sleeves 510 (which may be a single sleeve if only one stabilizer is used, or no sleeve if not stabilizer is used), the hinge portion 512, and the pivotable coupling 602. In one embodiment, the hinge portion 512 may be connected directly to the mast 104. Further, in another embodiment, the pivotable coupling 602 may or may not be included, depending on the needs of the construction attachment in relation to the construction machine to which the construction attachment is attached as well as the earth penetrating attachment attached to the Kelly-bar assembly 112.

Figure 9:
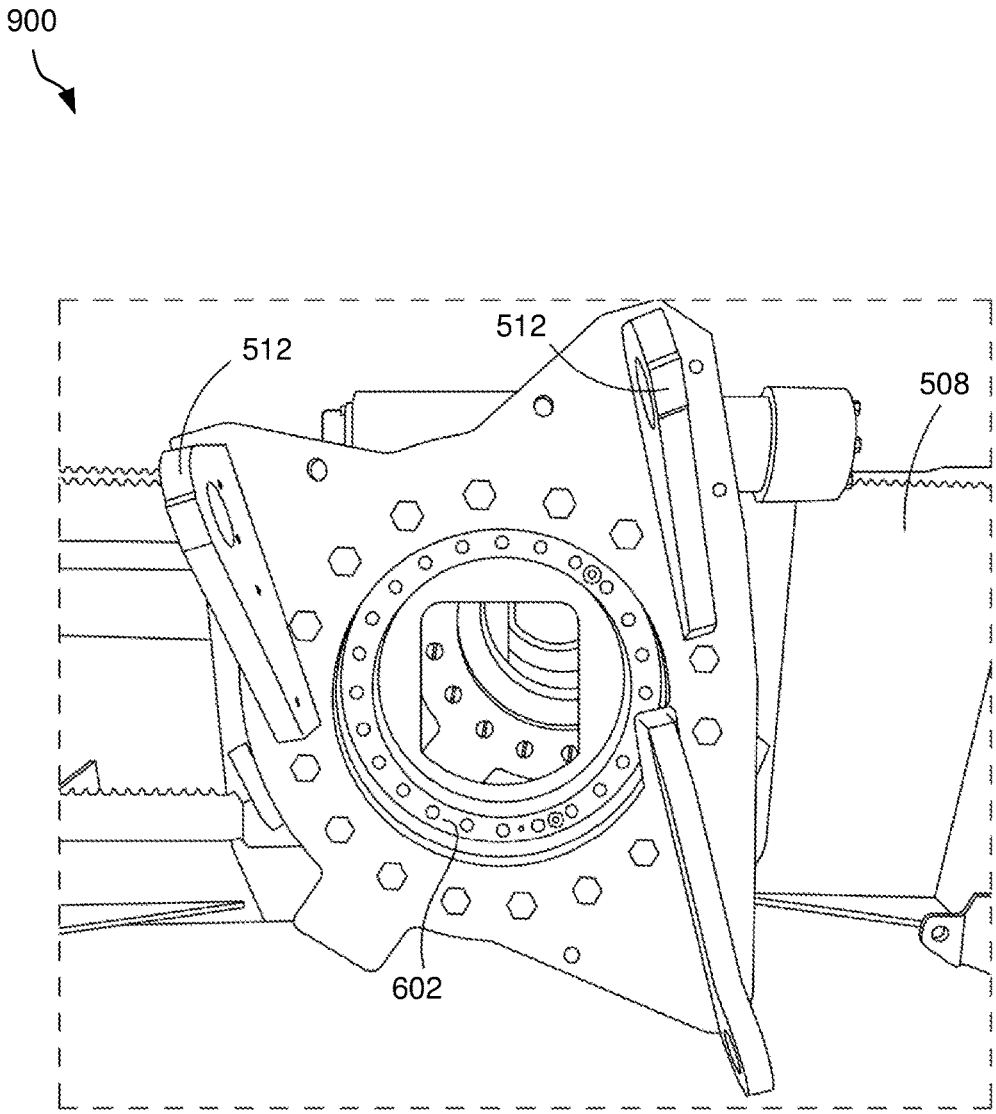
FIG. 9 illustrates a detailed view of the mast coupling assembly of the quick disconnect Kelly bar system, in accordance with one embodiment.

FIG. 9 illustrates a detailed view 900 of the mast coupling assembly of the quick disconnect Kelly bar system, in accordance with one embodiment. As an option, the detailed view 900 may be implemented in the context of any one or more of the embodiments set forth in any previous and/or subsequent figure(s) and/or description thereof. Of course, however, the detailed view 900 may be implemented in the context of any desired environment. Further, the aforementioned definitions may equally apply to the description below.

As shown, the detailed view 900 includes the attachment frame 508, the hinge portion 512 (or as shown, the hinge portions), and the pivotable coupling 602. The detailed view 900 provides another angle of the detailed view 800.

Figure 10:
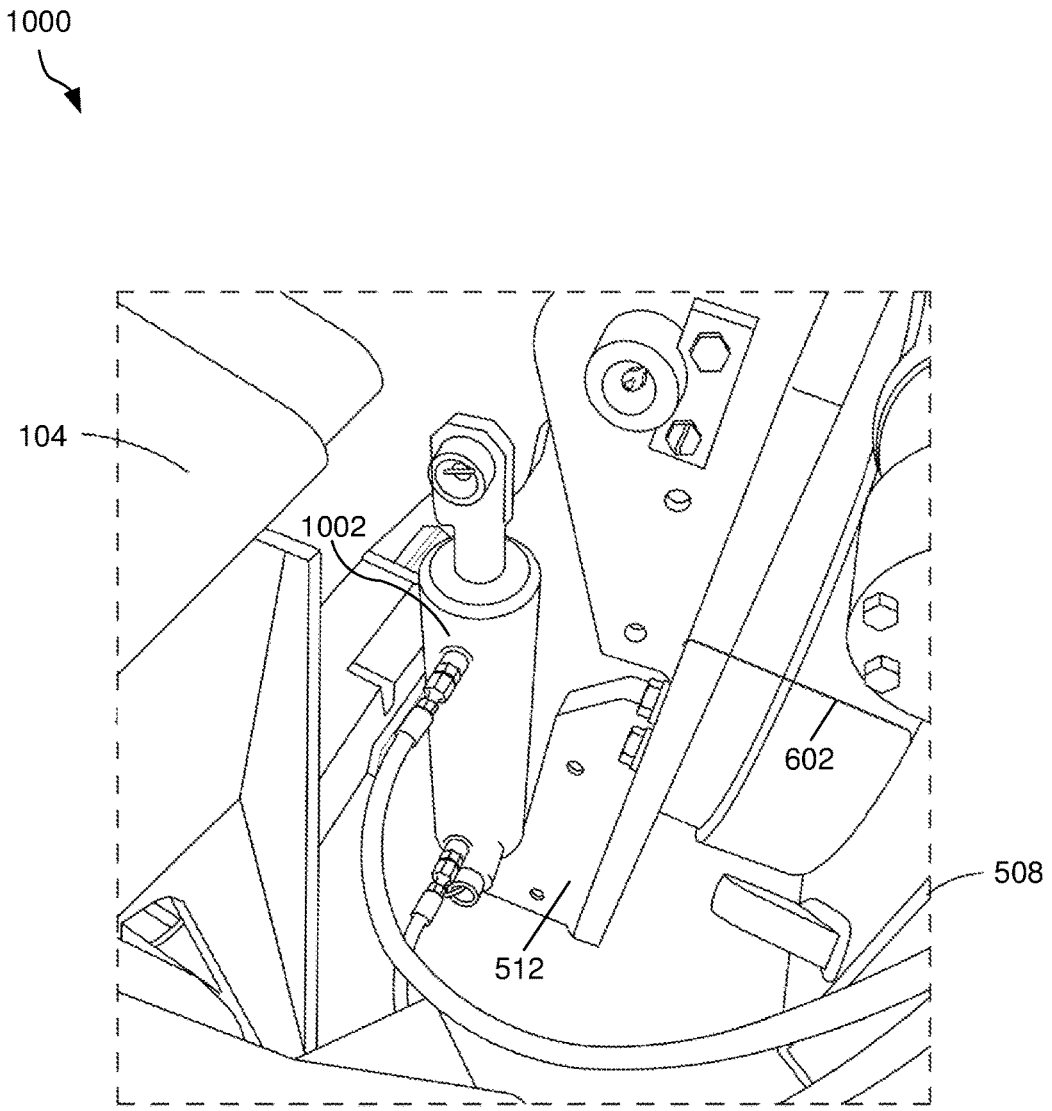
FIG. 10 illustrates a detailed view of the mast and swing assembly of the quick disconnect Kelly bar system, in accordance with one embodiment.

FIG. 10 illustrates a detailed view 1000 of the mast and swing system of the quick disconnect Kelly bar system, in accordance with one embodiment. As an option, the detailed view 1000 may be implemented in the context of any one or more of the embodiments set forth in any previous and/or subsequent figure(s) and/or description thereof. Of course, however, the detailed view 1000 may be implemented in the context of any desired environment. Further, the aforementioned definitions may equally apply to the description below.

As shown, the detailed view 1000 includes the mast 104, the pivotable coupling assembly 602, and the attachment frame 508. Further, a hydraulic cylinder 1002 is shown which may move the construction attachment via the hinge portion 512.

Figure 11:
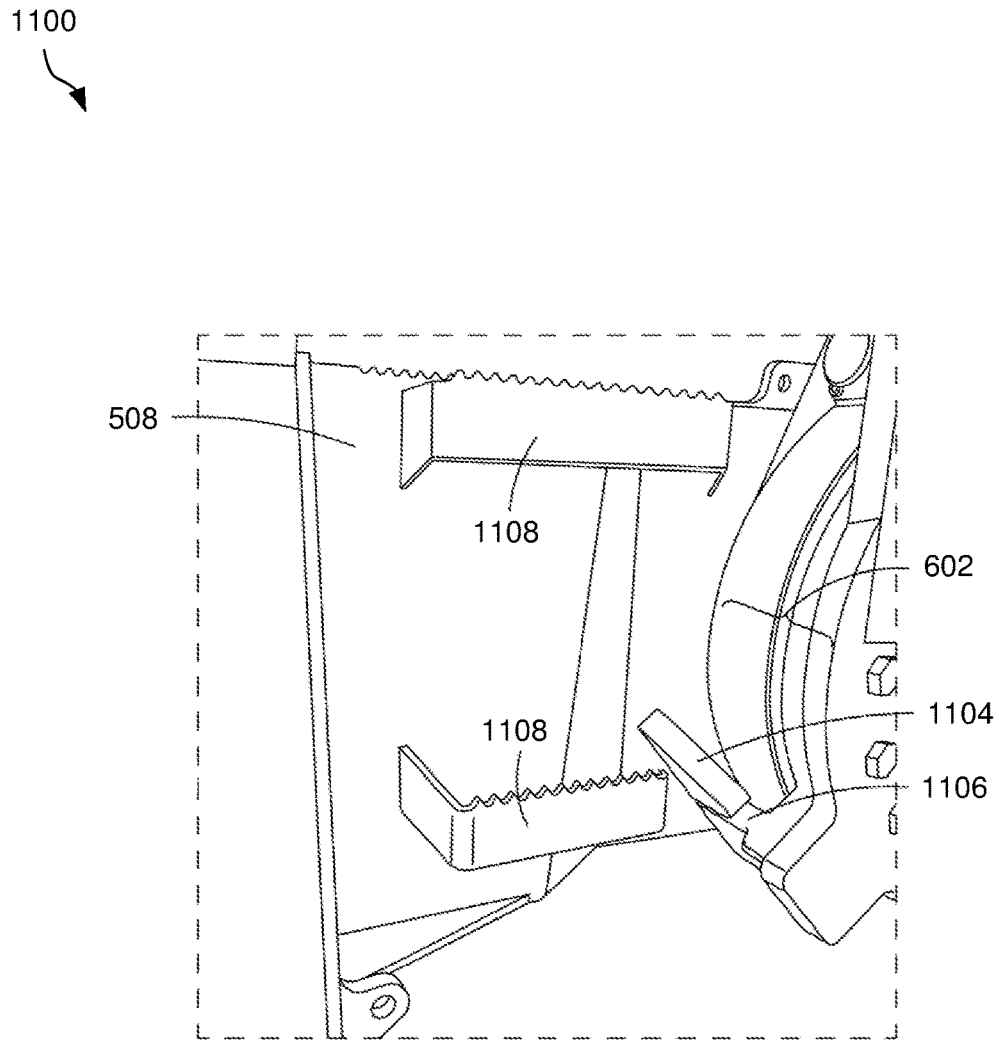
FIG. 11 illustrates a detailed view of the attachment frame and coupling assembly, in accordance with one embodiment.

FIG. 11 illustrates a detailed view 1100 of the attachment frame and coupling assembly, in accordance with one embodiment. As an option, the detailed view 1100 may be implemented in the context of any one or more of the embodiments set forth in any previous and/or subsequent figure(s) and/or description thereof. Of course, however, the detailed view 1100 may be implemented in the context of any desired environment. Further, the aforementioned definitions may equally apply to the description below.

As shown, the detailed view 1100 may include the attachment frame 508, the pivotable coupling 602, ladder rungs 1108 associated with the attachment frame 508, and rotation stops 1104 and 1106 of the pivotable coupling 602. It is to be appreciated that the rotation stops 1104 and 1106 of the pivotable coupling 602 are shown as one exemplary embodiment of how the attachment frame 508 and the pivotable coupling 602 may be configured. In other embodiments, the pivotable coupling 602 may not have the rotation stops 1104 and 1106.

Figure 12:
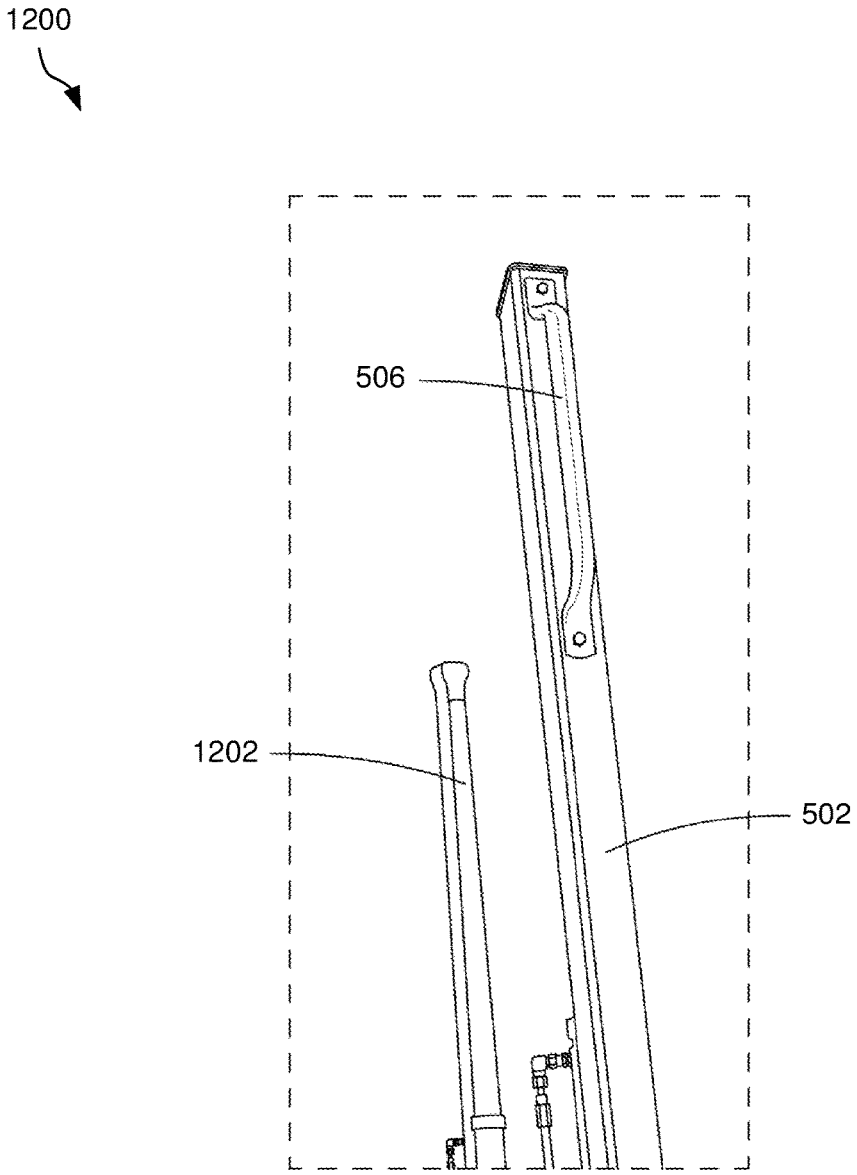
FIG. 12 illustrates a detailed view of the stabilizers and hydraulic assemblies, in accordance with one embodiment.

FIG. 12 illustrates a detailed view 1200 of the stabilizers and hydraulic assemblies, in accordance with one embodiment. As an option, the detailed view 1200 may be implemented in the context of any one or more of the embodiments set forth in any previous and/or subsequent figure(s) and/or description thereof. Of course, however, the detailed view 1200 may be implemented in the context of any desired environment. Further, the aforementioned definitions may equally apply to the description below.

As shown, the detailed view 1200 includes the one or more stabilizers 502, handles 506, and cylinders 1202. For example, the one or more stabilizers may be hydraulic actuated via the cylinder 1202. It is to be appreciated that while the one or more stabilizers 502 are depicted in the detailed view 1200 as vertically sliding members, additional embodiments can include opposing arms with each arm pivotably mounted to the frame and extending to a foot. Each of the arms can be hydraulically controlled. As such, the one or more stabilizers may be configured in various configurations.

Figure 13:
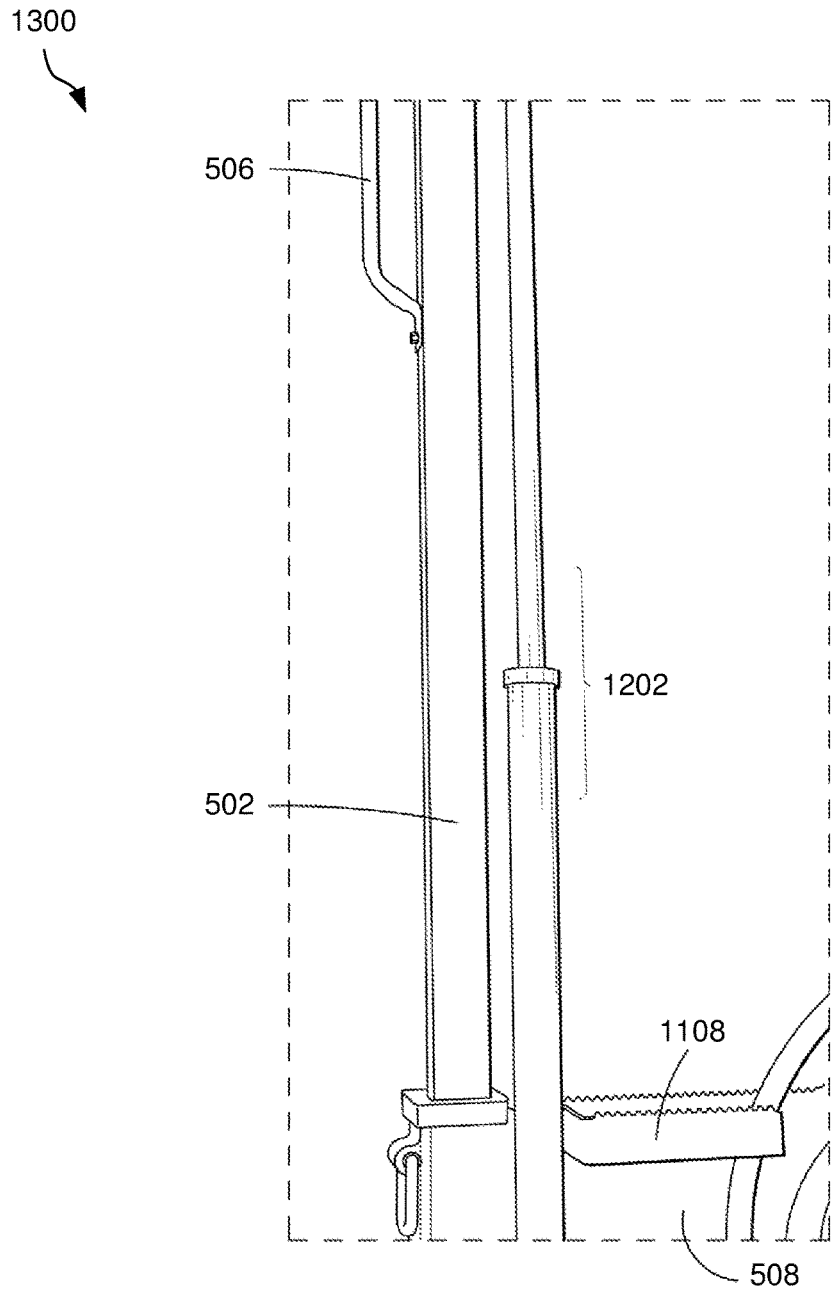
FIG. 13 illustrates another detailed view of the stabilizers, in accordance with one embodiment.

FIG. 13 illustrates another detailed view 1300 of the stabilizers, in accordance with one embodiment. As an option, the detailed view 1300 may be implemented in the context of any one or more of the embodiments set forth in any previous and/or subsequent figure(s) and/or description thereof. Of course, however, the detailed view 1300 may be implemented in the context of any desired environment. Further, the aforementioned definitions may equally apply to the description below.

As shown, the another detailed view 1300 includes the one or more stabilizers 502, the handles 506, the attachment frame 508, the ladder rungs 1108, and the cylinders 1202. The another detailed view 1300 provides another angle from the detailed view 1200.

Figure 14:
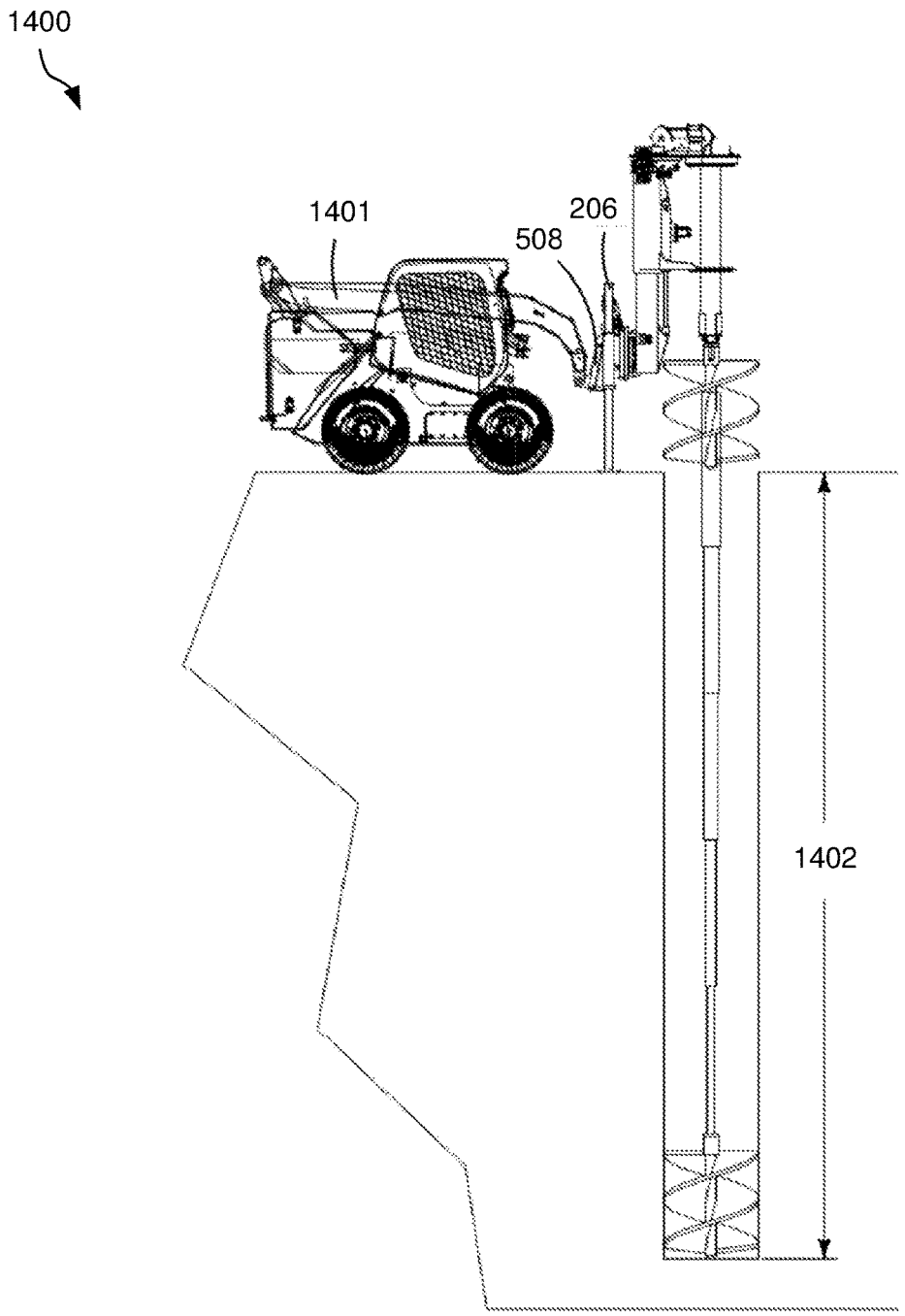
FIG. 14 illustrates a working view of a first configuration of the skid-steer loader and the quick disconnect Kelly bar system, in accordance with one embodiment.

FIG. 14 illustrates a working view 1400 of a first configuration of the skid-steer loader and the quick disconnect Kelly bar system, in accordance with one embodiment. As an option, the working view 1400 may be implemented in the context of any one or more of the embodiments set forth in any previous and/or subsequent figure(s) and/or description thereof. Of course, however, the working view 1400 may be implemented in the context of any desired environment. Further, the aforementioned definitions may equally apply to the description below.

As shown, a first configuration is shown in the working view 1400, including a skid steer 1401, the attachment frame 508, the one or more stabilizers 206, the distance 210, the distance 216, and a distance 1402. It is to be appreciated that although the skid steer 1401 is shown, any construction machine may be used in a similar manner.

In one embodiment, the Kelly bar assembly 112 may provide a depth up to forty (40) feet when being utilized, while only occupying a ten (10) foot height from elevation. As such, a drill depth can be multiple times the height of the construction machine (including the construction attachment), and the machine can be small enough fit inside of buildings and dwellings in lieu of stating actual height and depth. In one embodiment, the distance 1402 from the support surface to the base of a dig can be as much as 25 feet. Of course, it is to be appreciated that the depths provided herein are merely exemplary, where the depth may be a function of the height of the mast 104 and/or the configuration of the Kelly-bar assembly 112 (including the length of the assembly, the shape of the bars, the number of bars, etc.).

Figure 15:
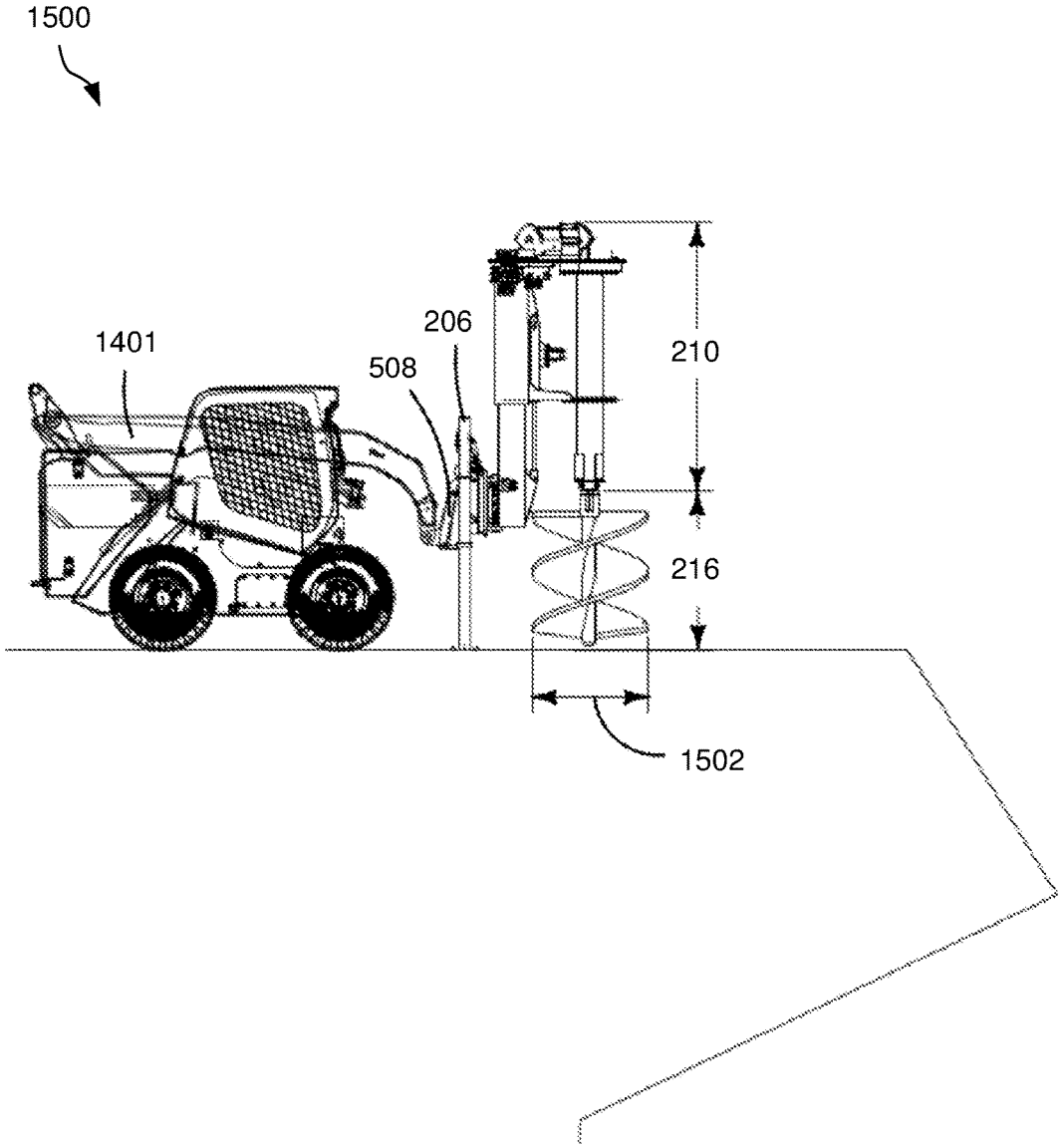
FIG. 15 illustrates a working view of a second configuration of the skid-steer loader and the quick disconnect Kelly bar system, in accordance with one embodiment.

FIG. 15 illustrates a working view 1500 of a second configuration of the skid-steer loader and the quick disconnect Kelly bar system, in accordance with one embodiment. As an option, the working view 1500 may be implemented in the context of any one or more of the embodiments set forth in any previous and/or subsequent figure(s) and/or description thereof. Of course, however, the working view 1500 may be implemented in the context of any desired environment. Further, the aforementioned definitions may equally apply to the description below.

As shown, a second configuration is shown in the working view 1500, including a skid steer 1401, the attachment frame 508, the one or more stabilizers 206, the distance 210, the distance 216, and a distance 1502. It is to be appreciated that although the skid steer 1401 is shown, any construction machine may be used in a similar manner. In one embodiment, Additionally, the distance 1502 can be as large as 36 inches. Of course, it is to be appreciated that the widths (such as the distance 1502) provided herein are merely exemplary, and the width may be a function of the size of the headblock 114, the mast 104, the Kelly-bar assembly 112, and/or a combination thereof.

Figure 16:
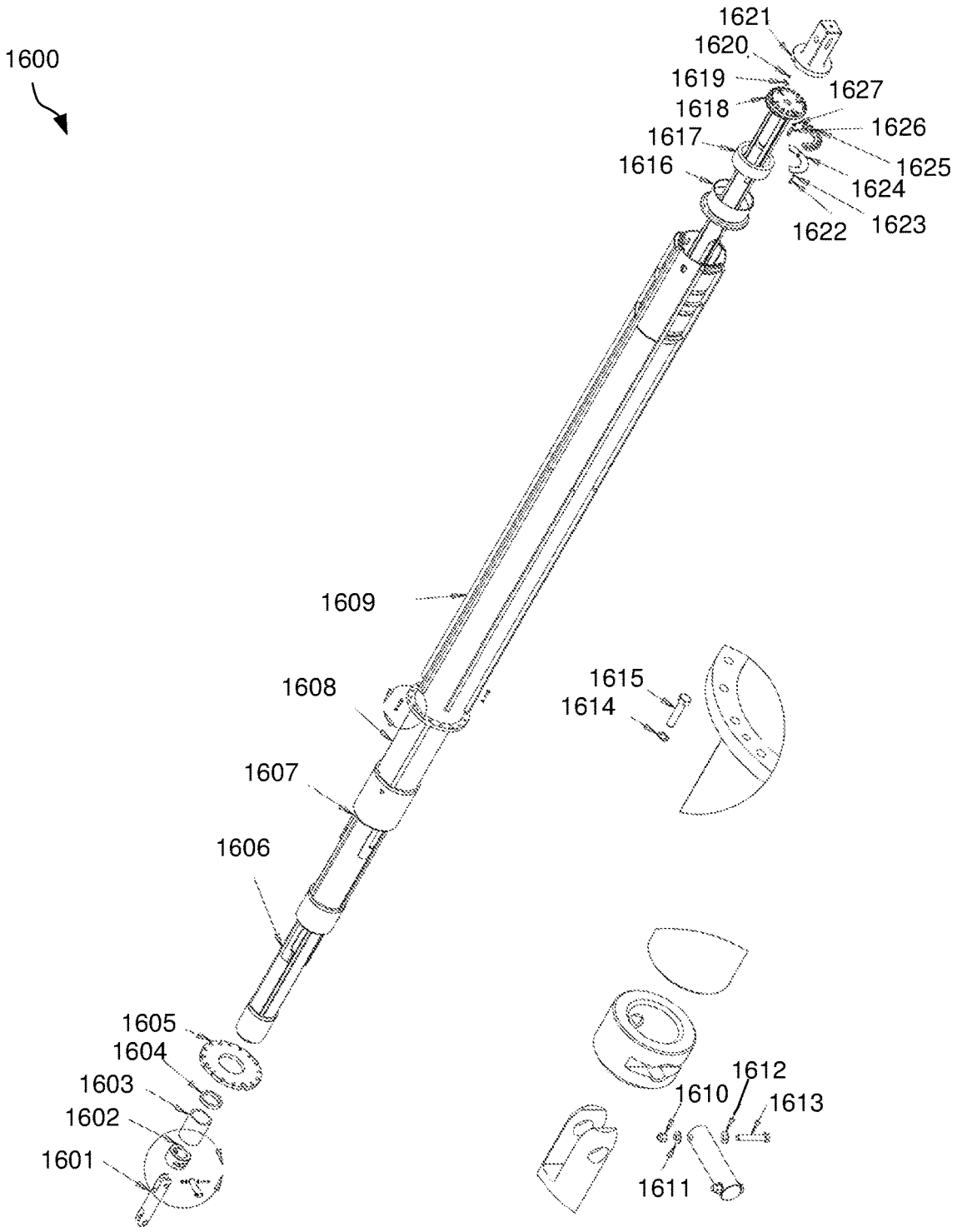
FIG. 16 illustrates a Kelly bar assembly, in accordance with one embodiment.

FIG. 16 illustrates a Kelly bar assembly 1600, in accordance with one embodiment. As an option, the Kelly bar assembly 1600 may be implemented in the context of any one or more of the embodiments set forth in any previous and/or subsequent figure(s) and/or description thereof. Of course, however, the Kelly bar assembly 1600 may be implemented in the context of any desired environment. Further, the aforementioned definitions may equally apply to the description below.

As shown, the Kelly bar assembly 112 is shown that includes a swivel 1601 coupled to a stop sleeve retainer 1602 which is operatively coupled to a stop sleeve 1603 which is operatively coupled to a stop ring 1604, and a bolt-on plate 1605. Additionally, the Kelly bar assembly 112 may continue with a first Kelly bar intermediate 1606, a second Kelly bar intermediate 1607, and a third Kelly bar intermediate 1608 which is operatively coupled to a Kelly bar drive tube 1609, which is shown in more detail to include a nylon inserted locknut 1610 as well as a stop sleeve 1611 which is operatively coupled to a washer 1612 and a bolt 1613. In another detail, a washer wedgelock 1614 can be operatively engaged with a bolt 1615.

At a terminal end of the Kelly bar assembly 112, a spring housing 1616 can be operably coupled to a spring elastomer 1617 which is operatively coupled to a Kelly bar inner 1618 which is engaged with the adapter assembly 1621 which can be operably engaged using key stock 1619 and spring pin 1620.

In one embodiment, the Kelly bar assembly 112 may include bolts 1622 coupling washer 1623 to plate spring 1624, and plate spring spacer 1625 coupled to bolts 1626 and washer wedgelocks 1627. While pins, bolts, or keys may be referenced it is recognized that these coupled devices as well as friction itself may be used to affix one or more the components of the assembly.

Figure 17:
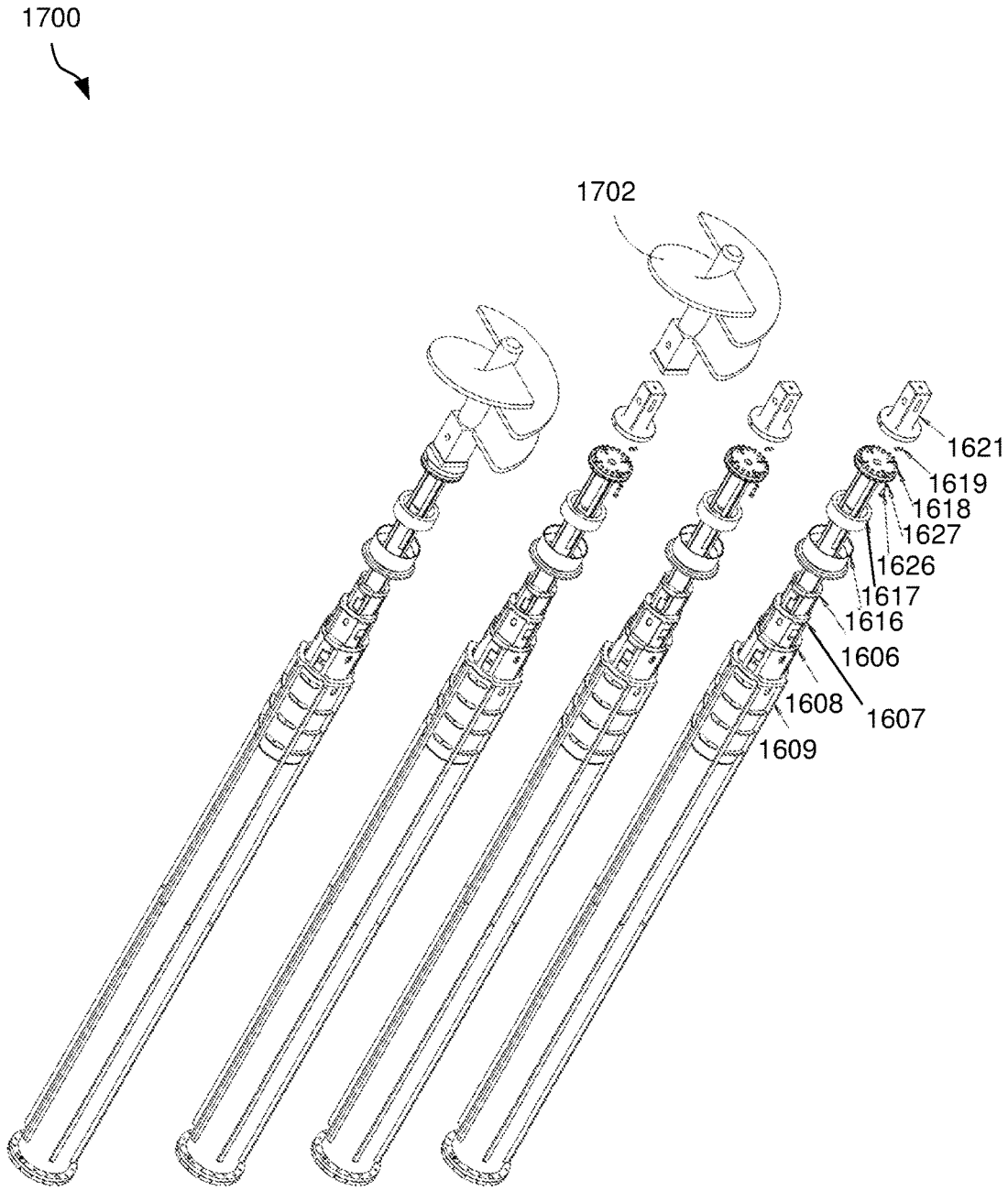
FIG. 17 illustrates a series of configurations of a Kelly bar assembly and auger assembly, in accordance with one embodiment.

FIG. 17 illustrates a series of configurations 1700 of a Kelly bar assembly and auger assembly, in accordance with one embodiment. As an option, the series of configurations 1700 may be implemented in the context of any one or more of the embodiments set forth in any previous and/or subsequent figure(s) and/or description thereof. Of course, however, the series of configurations 1700 may be implemented in the context of any desired environment. Further, the aforementioned definitions may equally apply to the description below.

As shown, various views of the Kelly bar assembly 112 are shown that includes a swivel 1601 coupled to a stop sleeve retainer 1602 which is operatively coupled to a stop sleeve 1603 which is operatively coupled to a stop ring 1604, and the bolt-on plate 1605. Additionally, the Kelly bar assembly 112 may continue with a first Kelly bar intermediate 1606, a second Kelly bar intermediate 1607, and a third Kelly bar intermediate 1608 which is operatively coupled to a Kelly bar drive tube 1609, which is shown in more detail to include a nylon inserted locknut 1610 as well as a stop sleeve 1611.

As shown, the Kelly bar assembly 112 may include a first Kelly bar intermediate 1606, a second Kelly bar intermediate 1607, and a third Kelly bar intermediate 1608 which is operatively coupled to a Kelly bar drive tube 1609. Additionally, at a terminal end of the Kelly bar assembly 112, a spring housing 1616 can be operably coupled to a spring elastomer 1617 which is operatively coupled to a Kelly bar inner 1618 which is engaged with the adapter assembly 1621 which can be operably engaged using key stock 1619. Further, the assembly may include bolts 1626 and washer wedgelocks 1627, as shown as well in the Kelly bar assembly 1600. Further, an auger 1702 is provided which may be attached to the adapter assembly 1621. It is to be appreciated that any attachment (and/or earth penetrating attachment) may be attached to the adapter assembly 1621.

In various embodiments, the Kelly bar assembly 1600 of FIG. 16 and/or the series of configurations 1700 of FIG. 17 may show one type of Kelly bar assembly system. For example, rather than provide a Kelly bar assembly with a welded-on adapter assembly, the Kelly bar assembly 1600 may include the adapter assembly 1621 which may be bolted on. In this manner, the adapter assembly 1621 can be removed and/or replaced as needed.

Further, in one embodiment, the Kelly bar assembly 1600 of FIG. 16 and/or the series of configurations 1700 of FIG. 17 may be modified and adapted for used with the construction attachment (such as that shown in FIG. 1). It is to be appreciated that the size and configuration of the Kelly bar assembly 1600 of FIG. 16 and/or the series of configurations 1700 of FIG. 17 may need to be modified (e.g. reduced in size) in order to be operable with the construction attachment. In this manner, in one embodiment, the Kelly bar assembly 1600 may be used in combination with the construction attachment (such as the depiction 100). It is to be appreciated, however, that the construction attachment should not be limited to only the Kelly-bar assembly 1600. For example, any type of Kelly-bar assembly may be used in combination with the construction attachment (as shown in the depiction 100).

Figure 18:
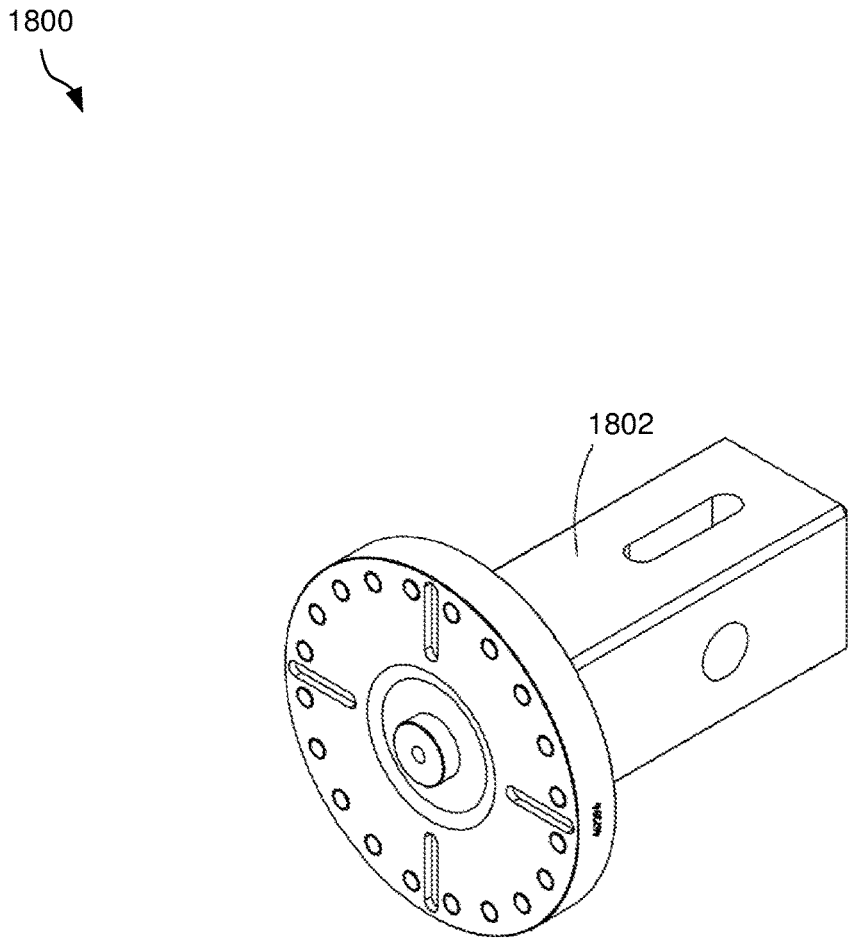
FIG. 18 illustrates a depiction of an auger adapter, in accordance with one embodiment.

FIG. 18 illustrates a depiction 1800 of an auger adapter, in accordance with one embodiment. As an option, the depiction 1800 may be implemented in the context of any one or more of the embodiments set forth in any previous and/or subsequent figure(s) and/or description thereof. Of course, however, the depiction 1800 may be implemented in the context of any desired environment. Further, the aforementioned definitions may equally apply to the description below.

As shown, a more detailed view of an adapter 1802 is provided. In one embodiment, the adapter 1802 may be a specific attachment fitting of the adapter assembly 1621.

Figure 19:
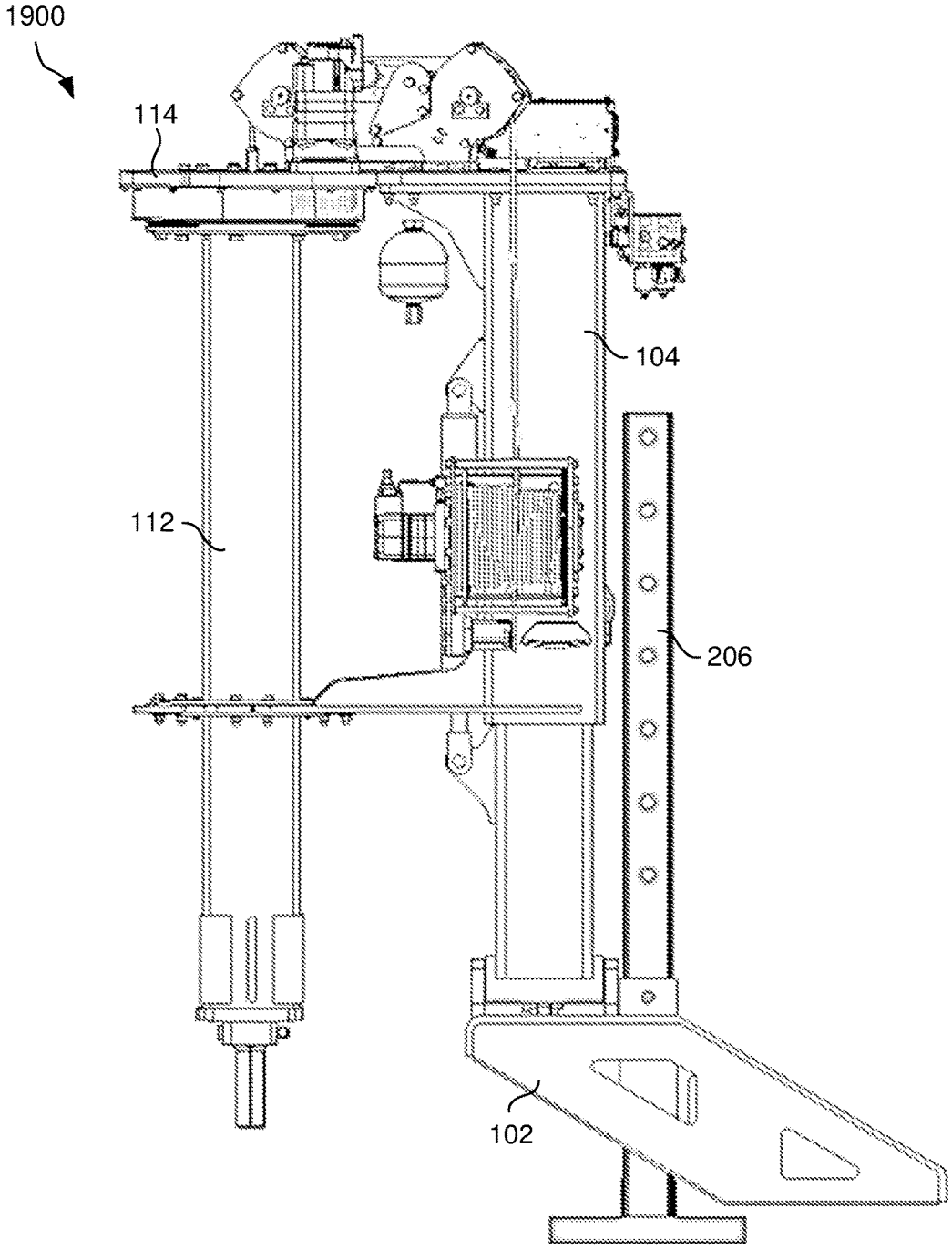
FIG. 19 illustrates another angle of the quick disconnect Kelly bar system, in accordance with one embodiment.

FIG. 19 illustrates another angle 1900 of the quick disconnect Kelly bar system, in accordance with one embodiment. As an option, the another angle 1900 may be implemented in the context of any one or more of the embodiments set forth in any previous and/or subsequent figure(s) and/or description thereof. Of course, however, the another angle 1900 may be implemented in the context of any desired environment. Further, the aforementioned definitions may equally apply to the description below.

As shown, the another angle 1900 includes the quick disconnect 102, the mast 104, the Kelly bar assembly 112, the headblock 114, and one or more stabilizers 206. The another angle 1900 is, as one example, another angle of the depiction 100.

As displayed, the one or more stabilizers 206 of FIG. 19 may be integrated within the quick disconnect 102 assembly (in a separate configuration to the one or more stabilizers being on a lateral edge as shown, e.g., in FIG. 2, 5, 7, etc.). Thus, the position of the one or more stabilizers 206 can vary, and the sleeve (in which the one or more stabilizers 206 slide) can also vary. In one embodiment, the one or more stabilizers 206 may include recessed slots in which a locking mechanism can be placed (to prevent the one or more stabilizers 206 from moving up or down). The locking mechanism may be inserted via a channel on the quick disconnect into the recessed slot of the one or more stabilizers 206. Further, the one or stabilizers 206 may include an integrated foot.

Further, as emphasized hereinabove, the design of the quick disconnect 102 may be modified based on the construction machine to which it is to be affixed. The quick disconnect of FIG. 19, in one embodiment, is shown with a quick disconnect 102 that would be compatible with a specific type of excavator.

Figure 20:
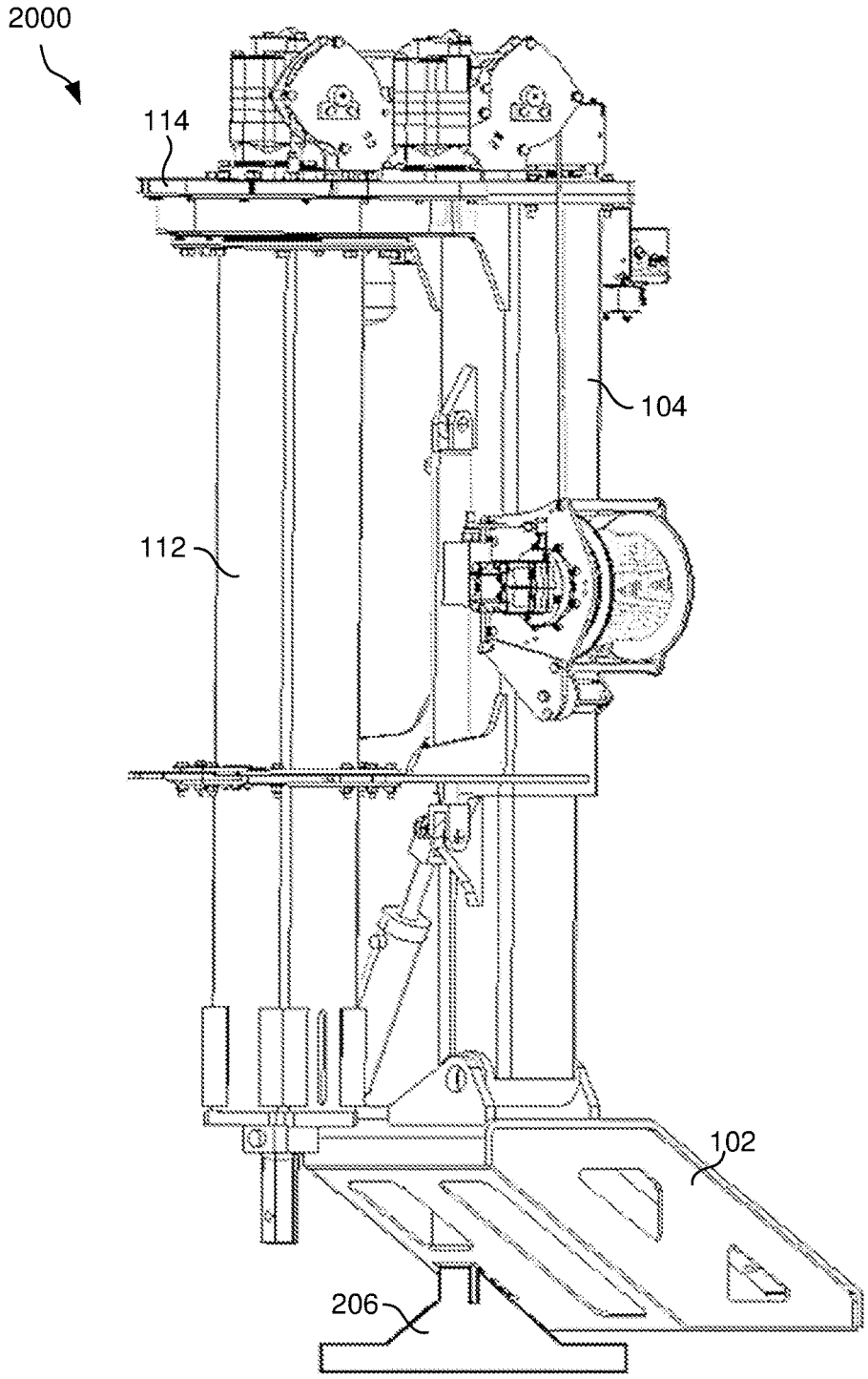
FIG. 20 illustrates another angle of the quick disconnect Kelly bar system, in accordance with one embodiment.

FIG. 20 illustrates another angle 2000 of the quick disconnect Kelly bar system, in accordance with one embodiment. As an option, the another angel 2000 may be implemented in the context of any one or more of the embodiments set forth in any previous and/or subsequent figure(s) and/or description thereof. Of course, however, the another angle 2000 may be implemented in the context of any desired environment. Further, the aforementioned definitions may equally apply to the description below.

As shown, the another angle 2000 includes the quick disconnect 102, the mast 104, the Kelly bar assembly 112, the headblock 114, and one or more stabilizers 206. The another angle 2000 is, as one example, another angle of the depiction 100.

Figure 21:
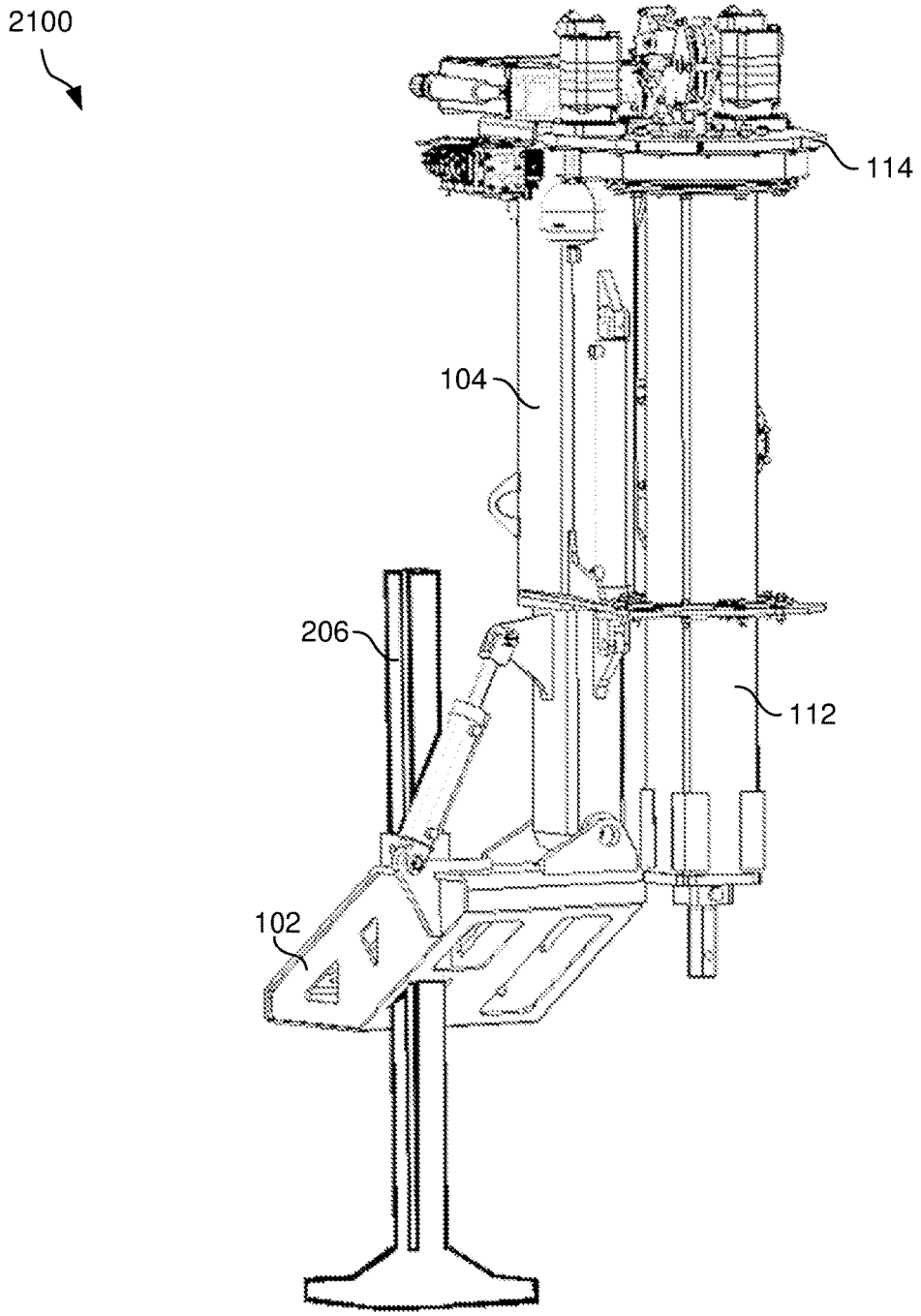
FIG. 21 illustrates another angle of the quick disconnect Kelly bar system, in accordance with one embodiment.

FIG. 21 illustrates another angle 2100 of the quick disconnect Kelly bar system, in accordance with one embodiment. As an option, the another angle 2100 may be implemented in the context of any one or more of the embodiments set forth in any previous and/or subsequent figure(s) and/or description thereof. Of course, however, the another angle 2100 may be implemented in the context of any desired environment. Further, the aforementioned definitions may equally apply to the description below.

As shown, the another angle 2100 includes the quick disconnect 102, the mast 104, the Kelly bar assembly 112, the headblock 114, and one or more stabilizers 206. The another angle 2100 is, as one example, another angle of the depiction 100. In one embodiment, the another angle 2100 shows the one or more stabilizers 206 partly lowered.

Figure 22:
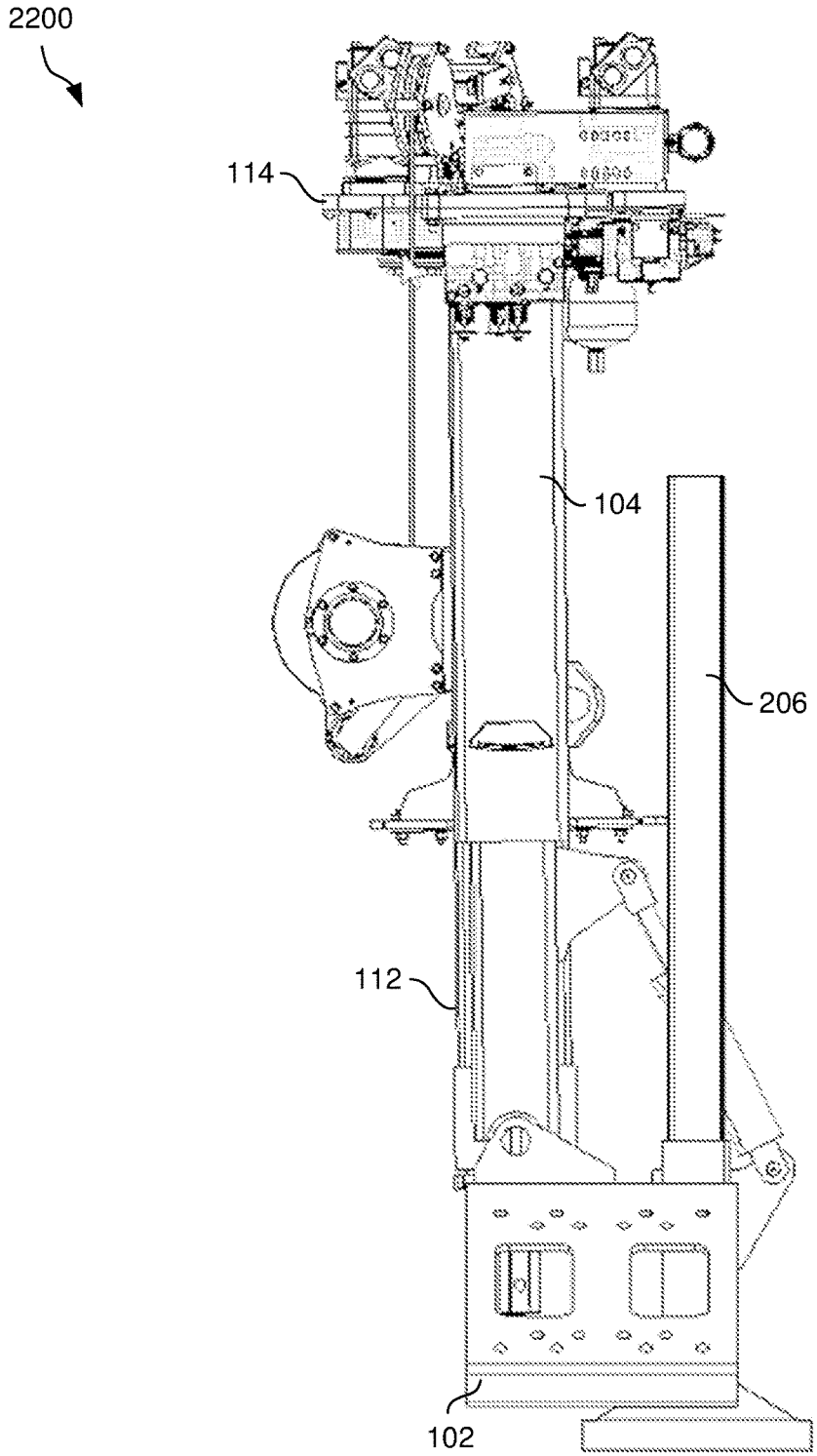
FIG. 22 illustrates another angle of the quick disconnect Kelly bar system, in accordance with one embodiment.

FIG. 22 illustrates another angle 2200 of the quick disconnect Kelly bar system, in accordance with one embodiment. As an option, the another angle 2200 may be implemented in the context of any one or more of the embodiments set forth in any previous and/or subsequent figure(s) and/or description thereof. Of course, however, the another angle 2200 may be implemented in the context of any desired environment. Further, the aforementioned definitions may equally apply to the description below.

As shown, the another angle 2200 includes the quick disconnect 102, the mast 104, the Kelly bar assembly 112, the headblock 114, and one or more stabilizers 206. The another angle 2200 is, as one example, another angle of the depiction 100.

Figure 23:
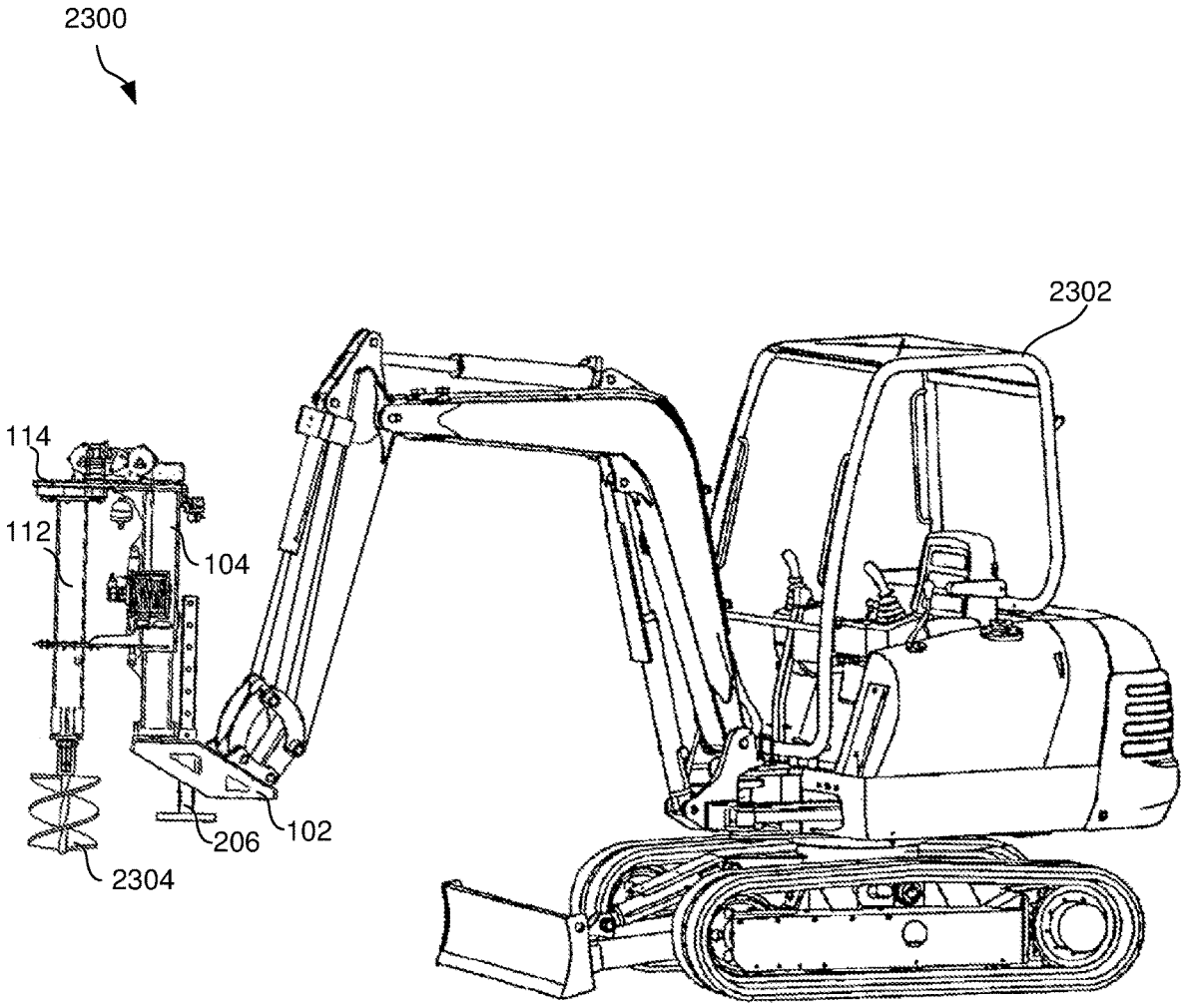
FIG. 23 illustrates a depiction of an excavator and the quick disconnect Kelly bar system, in accordance with one embodiment.

FIG. 23 illustrates a depiction 2300 of an excavator and the quick disconnect Kelly bar system, in accordance, in accordance with one embodiment. As an option, the depiction 2300 may be implemented in the context of any one or more of the embodiments set forth in any previous and/or subsequent figure(s) and/or description thereof. Of course, however, the depiction 2300 may be implemented in the context of any desired environment. Further, the aforementioned definitions may equally apply to the description below.

As shown, the depiction 2300 includes an excavator 2302, the quick disconnect 102, the mast 104, the headblock 114, the Kelly bar assembly 112, the one or more stabilizers 206, and an auger 2304 attached to the Kelly bar assembly 112. In one embodiment, the depiction 2300 shows the one or more stabilizers 206 in a raised position. It is noted that the depiction 2300 is not to scale. For example, the construction attachment would be much larger in proportion to the excavator 2302, as shown. As such, it is to be noted that the depiction 2300 (and others disclosed herein) are not drawn to scale, but in particular, are shown in reduced non scaled format for purposes of functionality.

Figure 24:
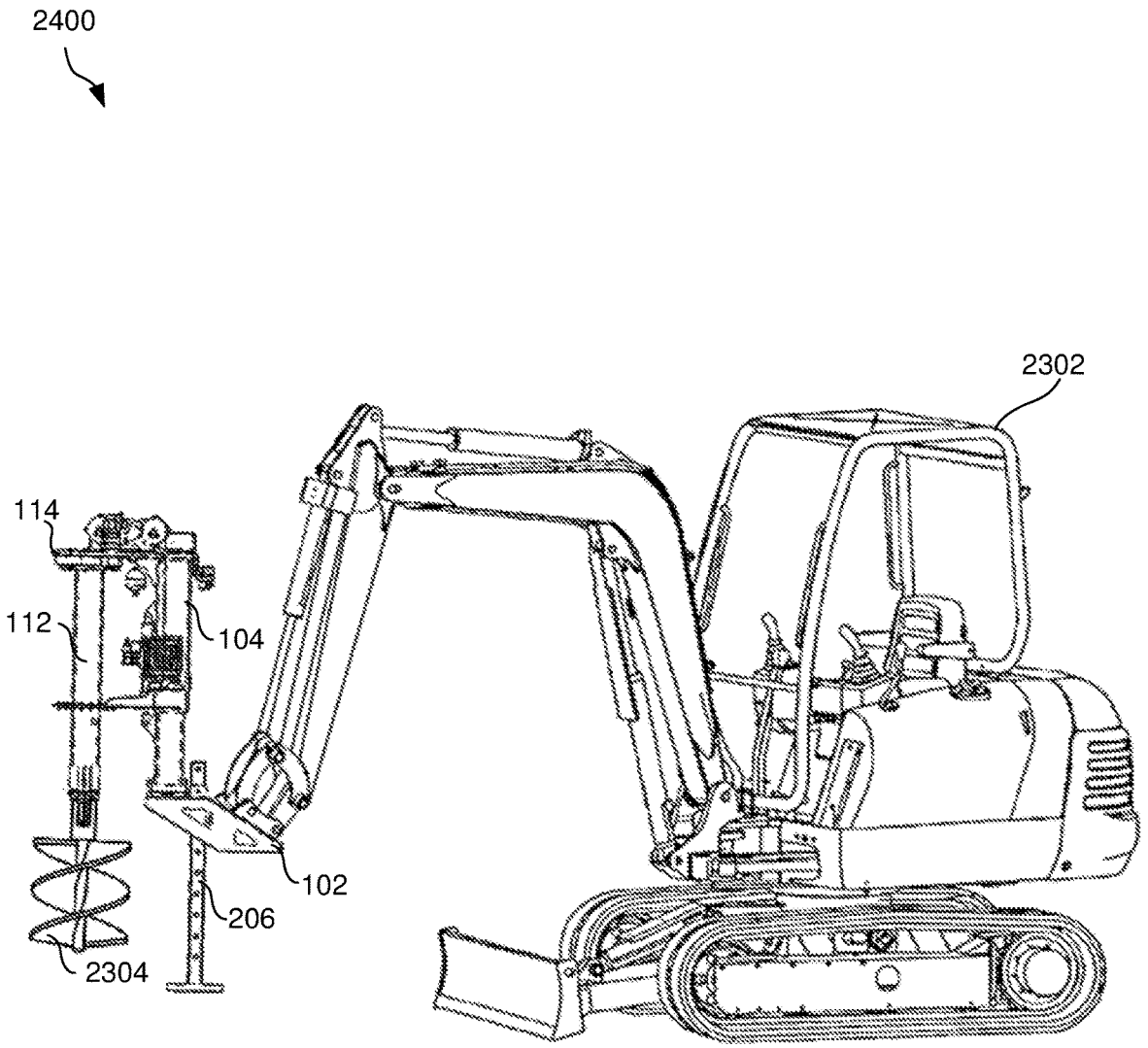
FIG. 24 illustrates another depiction of an excavator and the quick disconnect Kelly bar system, in accordance with one embodiment.

FIG. 24 illustrates another depiction 2400 of an excavator and the quick disconnect Kelly bar system, in accordance with one embodiment. As an option, the another depiction 2400 may be implemented in the context of any one or more of the embodiments set forth in any previous and/or subsequent figure(s) and/or description thereof. Of course, however, the another depiction 2400 may be implemented in the context of any desired environment. Further, the aforementioned definitions may equally apply to the description below.

As shown, the depiction 2400 includes an excavator 2302, the quick disconnect 102, the mast 104, the headblock 114, the Kelly bar assembly 112, the one or more stabilizers 206, and an auger 2304 attached to the Kelly bar assembly 112. In one embodiment, the depiction 2400 shows the one or more stabilizers 206 in a lowered position. With the one or more stabilizers 206 in a lowered position, the excavator may be more fully secured so that the auger 2304 can be lowered and penetrate the ground. It is to be appreciated that the one or more stabilizers 206 may not be needed based on the construction machine that is being used. For example, a larger construction machine with a greater mass may not tilt as greatly as a smaller construction machine with less mass, as the auger is removed from the ground. In various embodiments, the one or more stabilizers 206 may be used to control a tilt of the construction machine. Additionally, as discussed above within the context of the depiction 2300, the depiction 2400 in like manner is not to scale.

Figure 25:
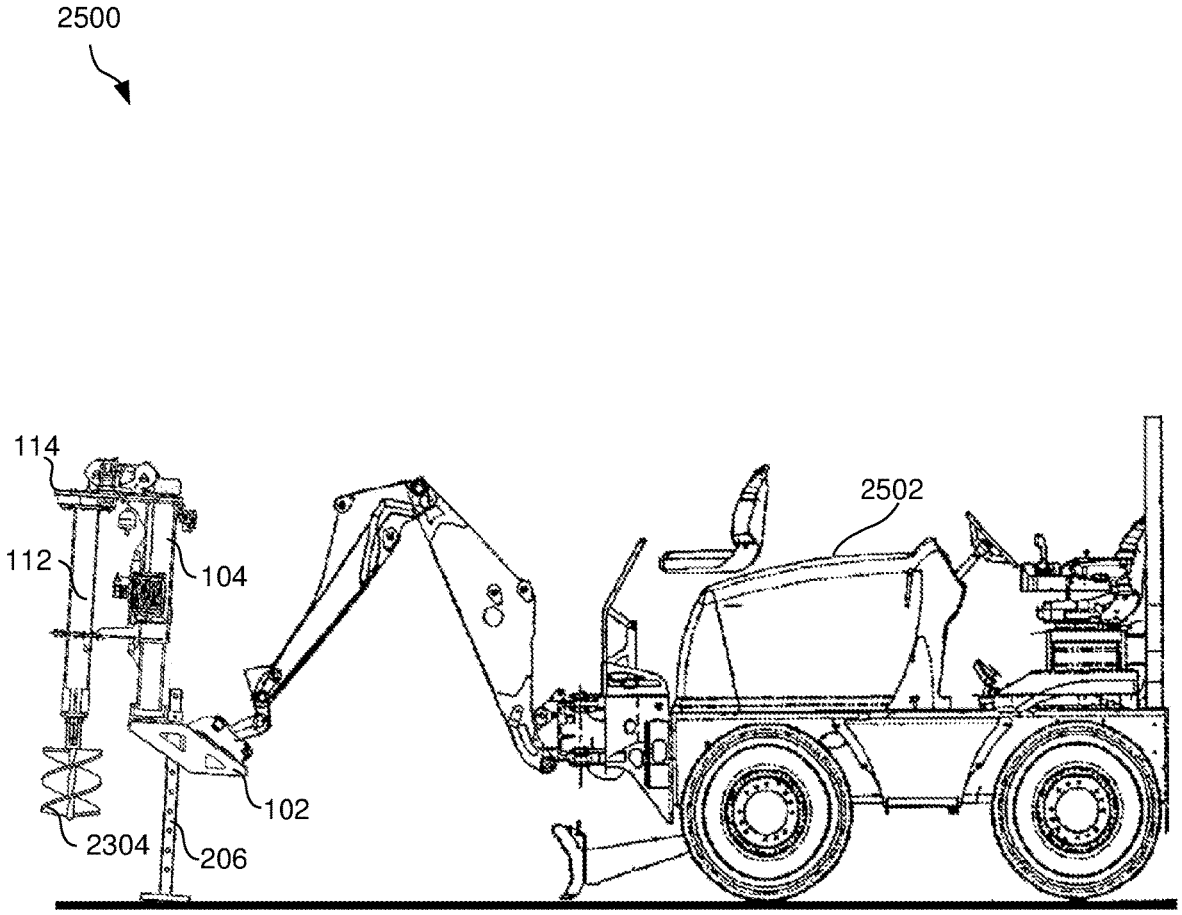
FIG. 25 illustrates a depiction of a trencher and the quick disconnect Kelly bar system, in accordance with one embodiment.

FIG. 25 illustrates a depiction 2500 of a trencher and the quick disconnect Kelly bar system, in accordance with one embodiment. As an option, the depiction 2500 may be implemented in the context of any one or more of the embodiments set forth in any previous and/or subsequent figure(s) and/or description thereof. Of course, however, the depiction 2500 may be implemented in the context of any desired environment. Further, the aforementioned definitions may equally apply to the description below.

As shown, the depiction 2500 includes a trencher 2502, the quick disconnect 102, the mast 104, the headblock 114, the Kelly bar assembly 112, the one or more stabilizers 206, and an auger 2304 attached to the Kelly bar assembly 112. In one embodiment, the depiction 2300 shows the one or more stabilizers 206 in a lowered position.

As noted herein, the quick disconnect 102 may be modified based on the construction machine to which it is affixed. Thus, the quick disconnect 102 as displayed in the depiction 2500 could be altered as needed based on the quick disconnect requirements of the construction machine (e.g. universal quick disconnect, machine-specific quick disconnect, manufacturer-specific quick disconnect, etc.). Additionally, as discussed above within the context of the depiction 2300, the depiction 2500 in like manner is not to scale.

Figure 26:
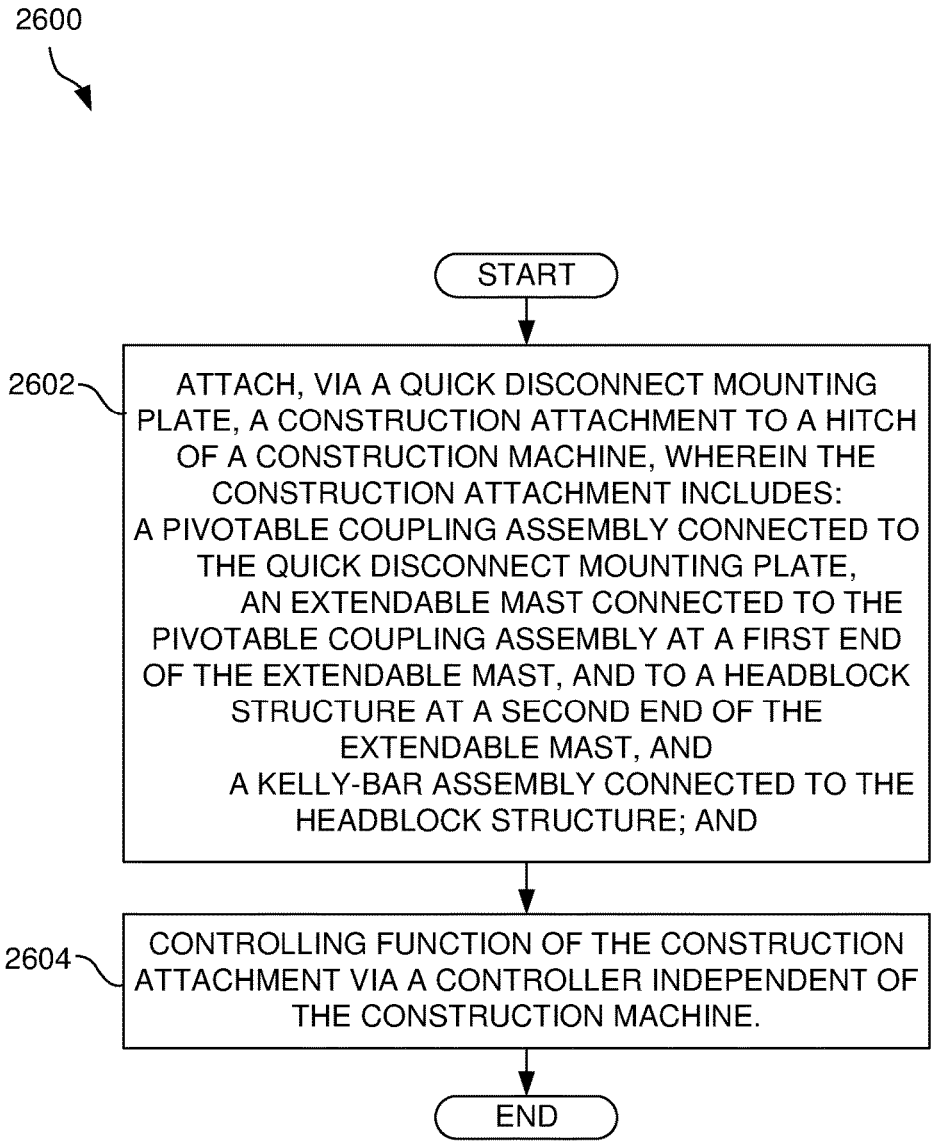
FIG. 26 illustrates a method for controlling a function of the quick disconnect Kelly bar system, in accordance with one embodiment.

FIG. 26 illustrates a method 2600 for controlling a function of the quick disconnect Kelly bar system, in accordance with one embodiment. As an option, the method 2600 may be implemented in the context of any one or more of the embodiments set forth in any previous and/or subsequent figure(s) and/or description thereof. Of course, however, the method 2600 may be implemented in the context of any desired environment. Further, the aforementioned definitions may equally apply to the description below.

As shown, the method 2600 begins with attaching, via a quick disconnect assembly, a construction attachment to a non-dedicated construction machine. See operation 2602. Next, auxiliary pressure and power lines are connected from the construction attachment to the non-dedicated construction machine. See operation 2604. As discussed herein, the auxiliary pressure and power lines may be used to provide electric and hydraulic capabilities to the construction attachment.

In use, the method 2600 may include attaching, via a quick disconnect mounting plate, a construction attachment to a hitch of a construction machine, where the construction attachment includes: a pivotable coupling assembly connected to the quick disconnect mounting plate, an extendable mast connected to the pivotable coupling 103 assembly at a first end of the extendable mast, and to a headblock structure at a second end of the extendable mast, and a Kelly-bar assembly connected to the headblock structure. See operation 2602.

Additionally, function of the construction attachment may be controlled via a controller independent of the construction machine. See operation 2604. In one embodiment, auxiliary pressure and auxiliary power lines may be connected from the construction machine to the construction attachment. Additionally, placement of the construction attachment may be controlled via the construction machine.

Figure 27:
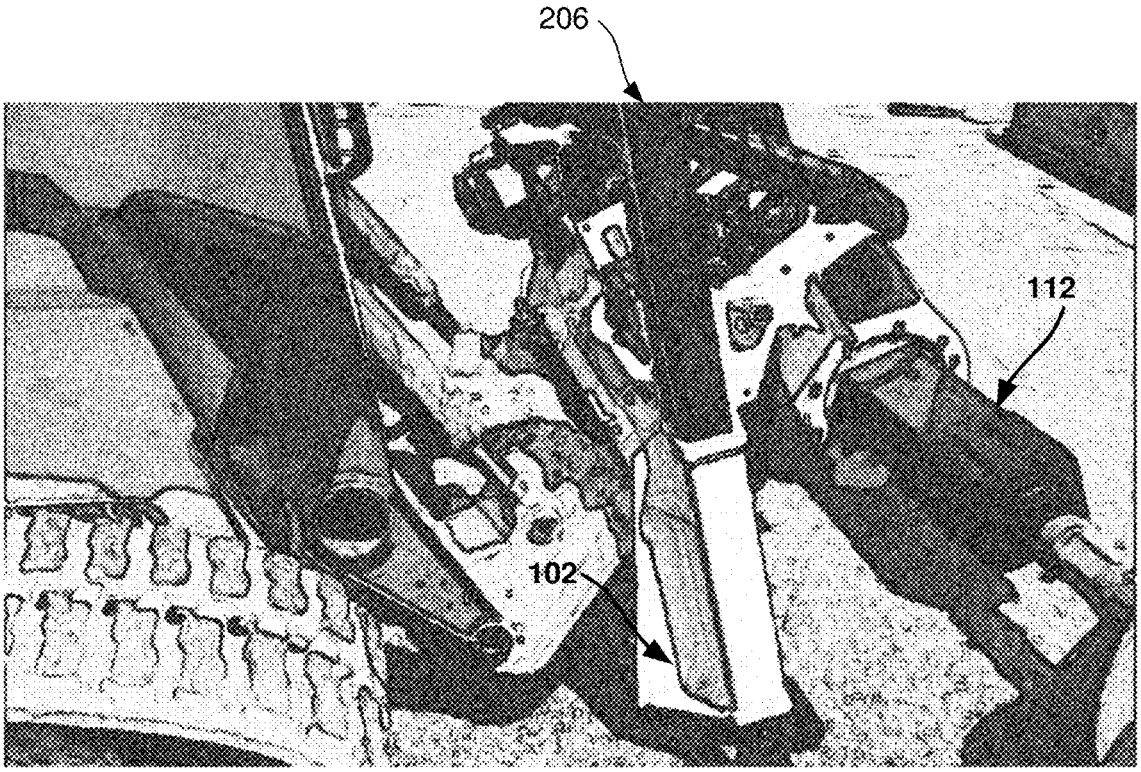
FIG. 27 illustrates a depiction of the quick disconnect Kelly bar system being attached to a skid-steer, in accordance with one embodiment.

FIG. 27 illustrates a depiction 2700 of the quick disconnect Kelly bar system being attached to a skid-steer, in accordance with one embodiment. As an option, the depiction 2700 may be implemented in the context of any one or more of the embodiments set forth in any previous and/or subsequent figure(s) and/or description thereof. Of course, however, the depiction 2700 may be implemented in the context of any desired environment. Further, the aforementioned definitions may equally apply to the description below.

As shown, the depiction 2700 may include a quick disconnect 102, the Kelly bar assembly 112, and the one or more stabilizers 206. The depiction 2700 includes an adaptation for a skid steer construction machine. In like manner, however, the quick disconnect 102 may be modified to accommodate any construction machine.

Figure 28:
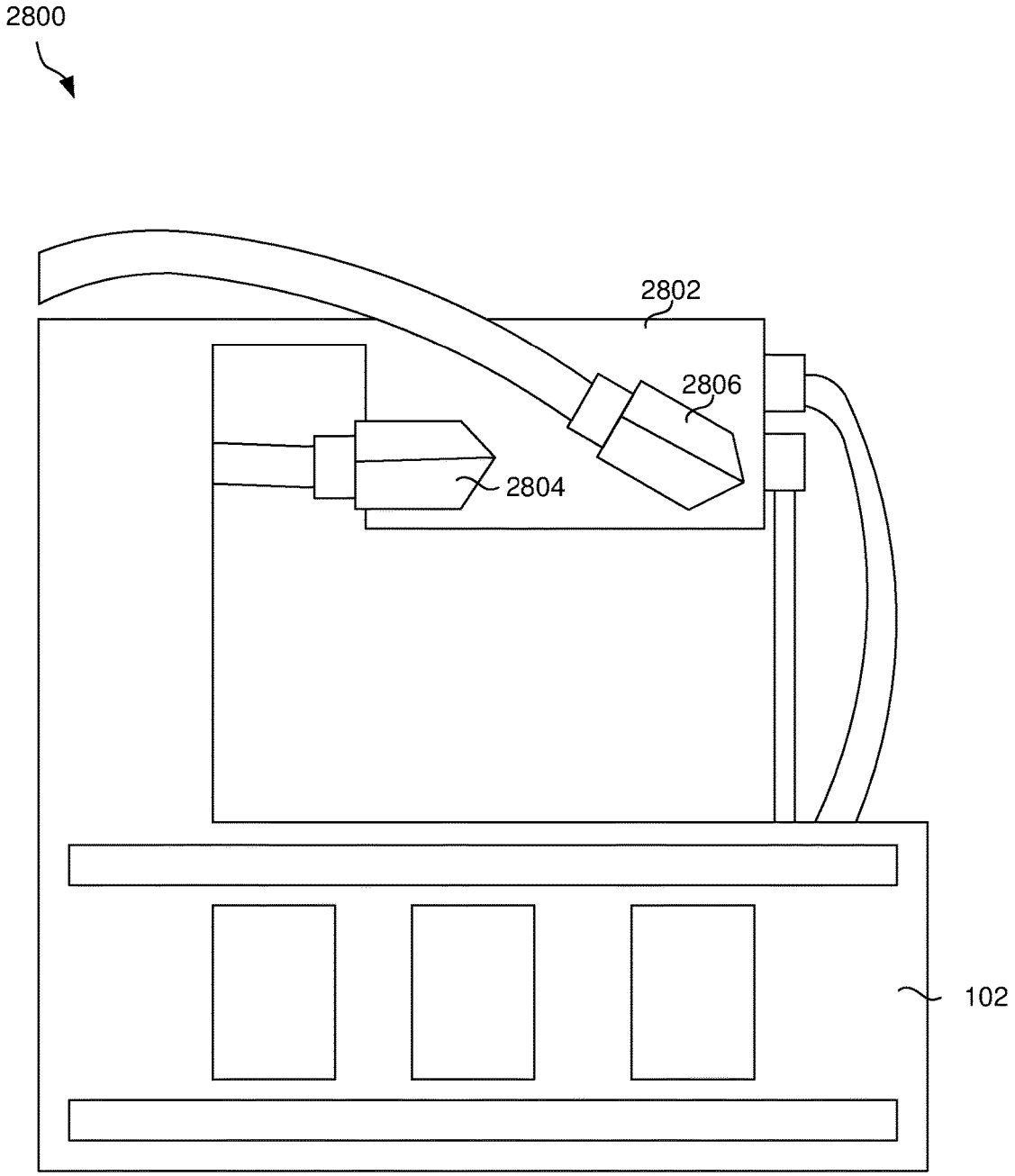
FIG. 28 illustrates a depiction of pressure and tank lines of the quick disconnect Kelly bar system, in accordance with one embodiment.

FIG. 28 illustrates a depiction 2800 of pressure and tank lines of the quick disconnect Kelly bar system, in accordance with one embodiment. As an option, the depiction 2800 may be implemented in the context of any one or more of the embodiments set forth in any previous and/or subsequent figure(s) and/or description thereof. Of course, however, the depiction 2800 may be implemented in the context of any desired environment. Further, the aforementioned definitions may equally apply to the description below.

As shown, the depiction 2800, the quick disconnect 102 may be attached to a distribution block 2802, which in turn may include a tank line 2804 and/or a pressure line 2806. Both the tank line 2804 and the pressure line 2806 may be connected to the construction machine so that hydraulic functionality can be provided to the construction attachment. It is to be appreciated that the pressure and return hoses can include a quick disconnect coupler, and/or may be configured to be specific to the construction machine to which it is to be connected. Further, the design of the distribution block 2802 should not be constrained to that specifically shown in the depiction 2800. For example, the distribution block 2802 may (or may not) be connected to one continuous metal sheet of the quick disconnect 102. The distribution block 2802 may be connected (e.g. bolted, welded, etc.) and/or otherwise attached to the quick disconnect 102.

Figure 29:
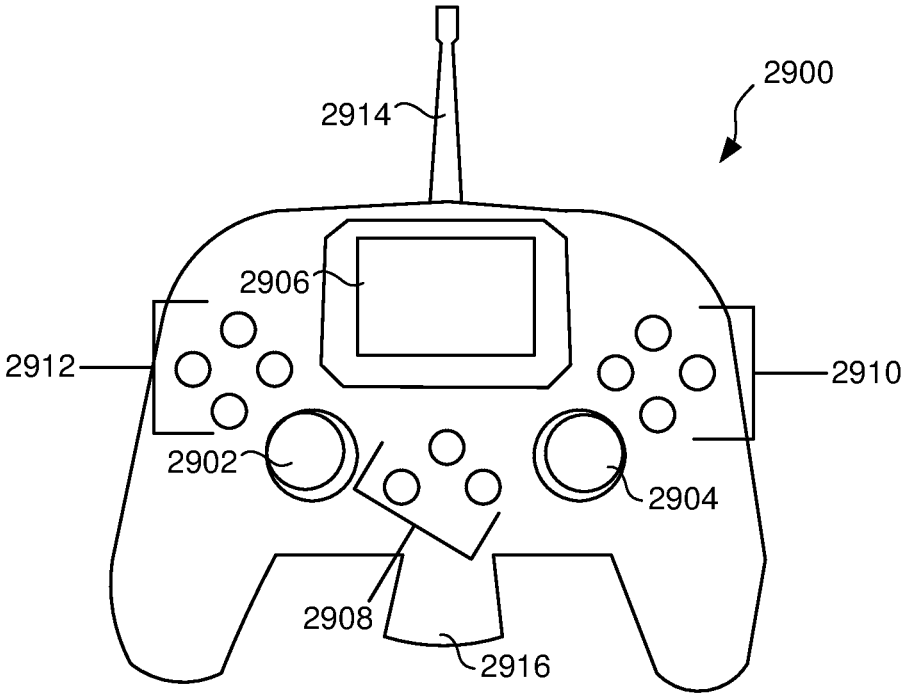
FIG. 29 illustrates a depiction of a wireless controller of the quick disconnect Kelly bar system, in accordance with one embodiment.

FIG. 29 illustrates a depiction 2900 of a wireless controller of the quick disconnect Kelly bar system, in accordance with one embodiment. As an option, the depiction 2900 may be implemented in the context of any one or more of the embodiments set forth in any previous and/or subsequent figure(s) and/or description thereof. Of course, however, the depiction 2900 may be implemented in the context of any desired environment. Further, the aforementioned definitions may equally apply to the description below.

As shown, the depiction 2900 includes a wireless controller including a first joystick 2902, a second joystick 2904, a screen 2906, a first set of controls 2908, a second set of controls 2910, a third set of controls 2912, an antenna 2914, and an activator 2916. It is to be appreciated that the controls of the depiction 2900 may be changed and programmed as needed. As such, a specific function programmed to a control button, as discussed herein, is intended to be interpreted solely as an example of what can be programmed.

It is to be understood that although a wireless controller is shown in the depiction 2900, a wired controller with near same functionality (not shown) may be used. In one embodiment, one difference between the wireless controller and a wired controller may include the wired controller communicating with the construction attachment wireless via a cable and/or wire connected between the wired controller and the construction attachment.

In various embodiments, the first joystick 2902 may control function of lowering/raising the Kelly bars of the Kelly bar assembly 112, and/or swinging the drill left/right. The second joystick 2904 may control function of advancing/retracting the Kelly bars of the Kelly bar assembly 112, and/or rotating an auger (e.g. or an earth penetrating attachment attached to the Kelly bar assembly 112) clockwise/counterclockwise. The screen 2906 may provide prompts relating to functions invoked (by pressing a function button), and/or provide status information associated with the construction attachment.

In other embodiments, the first set of controls 2908 may include power, settings, and pause function. The second set of controls 2910 may include tilt the construction to the right/left, and/or raise/lower right a stabilizer. The third set of controls 2912 may include high/low speed operation, and/or raise/lower a left stabilizer. Of course, it is to be appreciated that any number of stabilizers (or no number of stabilizers) may be required based on the construction machine to which the construction attachment is attached. Thus, the control function may be programmed dependent on the specific elements of the construction attachment that are included for the specific construction machine.

An antenna 2914 allows for wireless transmission of the controls to the construction attachment. Further, the activator 2916 engages the controller functions. In one embodiment, the activator 2916 may be turned clockwise and released to engage the controller functions. In another embodiment, the activator may be used to enable an e-stop which may disable the construction attachment when pressed. Further, the construction attachment may be disabled if the wireless controller is dropped. Additionally, although not shown, the wireless controller may include functions associated with one or more triggers on the wireless controller (e.g. crowd up/down, rotate left/right, etc.).

In various embodiments, the following provides additional details to the functions which may (or may not) be included on the depiction 2900. Swing left may refer to a function that moves the construction attachment to the left. This function may be used to move the construction attachment back to the drill location after spinning debris off of the auger. Swing right may refer to a function that moves the attachment to the right. This function may be used to move the auger from the drill location to an area for removing debris (otherwise known as spin-off). Kelly up may refer to a function that raises the Kelly bars. In one embodiment, before raising the Kelly bars, it may be beneficial to ensure the crowd (discussed below) is reset by using the retract function. Further, Kelly down may refer to a function that lowers the Kelly bars. In one embodiment, this function may be used to lower the bars until the tool (such as an auger) makes contact with the ground. Left stabilizer up may refer to a left stabilizer being raised. Left stabilizer down may refer to a left stabilizer being lowered. High/low speed operation may refer to a function where, when activated, the construction attachment can switch between a high-speed mode and a low-speed mode. For example, a high-speed mode may be used for removing debris from the tool (for spin-off), and a low-speed mode may be used (in one embodiment) for drilling.

Continuing on, rotate tool clockwise may refer to a function that rotates an attachment tool (such as an auger) clockwise so that it can advance into the ground. Rotate tool counterclockwise may refer to a function that rotates the attachment tool (such as an auger) counterclockwise, and may be used to unlock the Kelly bars. Crowd may refer to advancement of the Kelly bars. For example, this function may be used to advance the Kelly bars (and thus an auger attached to an end of the Kelly bars) into the ground. In one embodiment, the crowd may used simultaneously while rotating the auger clockwise. Retract may refer to retracting the Kelly bars. In one embodiment, retract may include resetting a crowd function. Further, in another embodiment, the Kelly bars may be retracted before using the Kelly up function.

Continuing on, right stabilizer up may refer to raising a right stabilizer. Left stabilizer may refer to lowering a right stabilizer. Side tilt left may refer to tilting the construction attachment to the left. Additionally, side tilt right may refer to titling the construction attachment to the right.

In this manner, complete control of the construction attachment may be achieved by using the wireless controller of the depiction 2900. In one embodiment, as discussed herein, positioning the construction attachment (including fore/aft tilt positioning) may be achieved by the construction machine. All other functions relating to the construction attachment may be achieved through the wireless controller of the depiction 2900.

Figure 30:
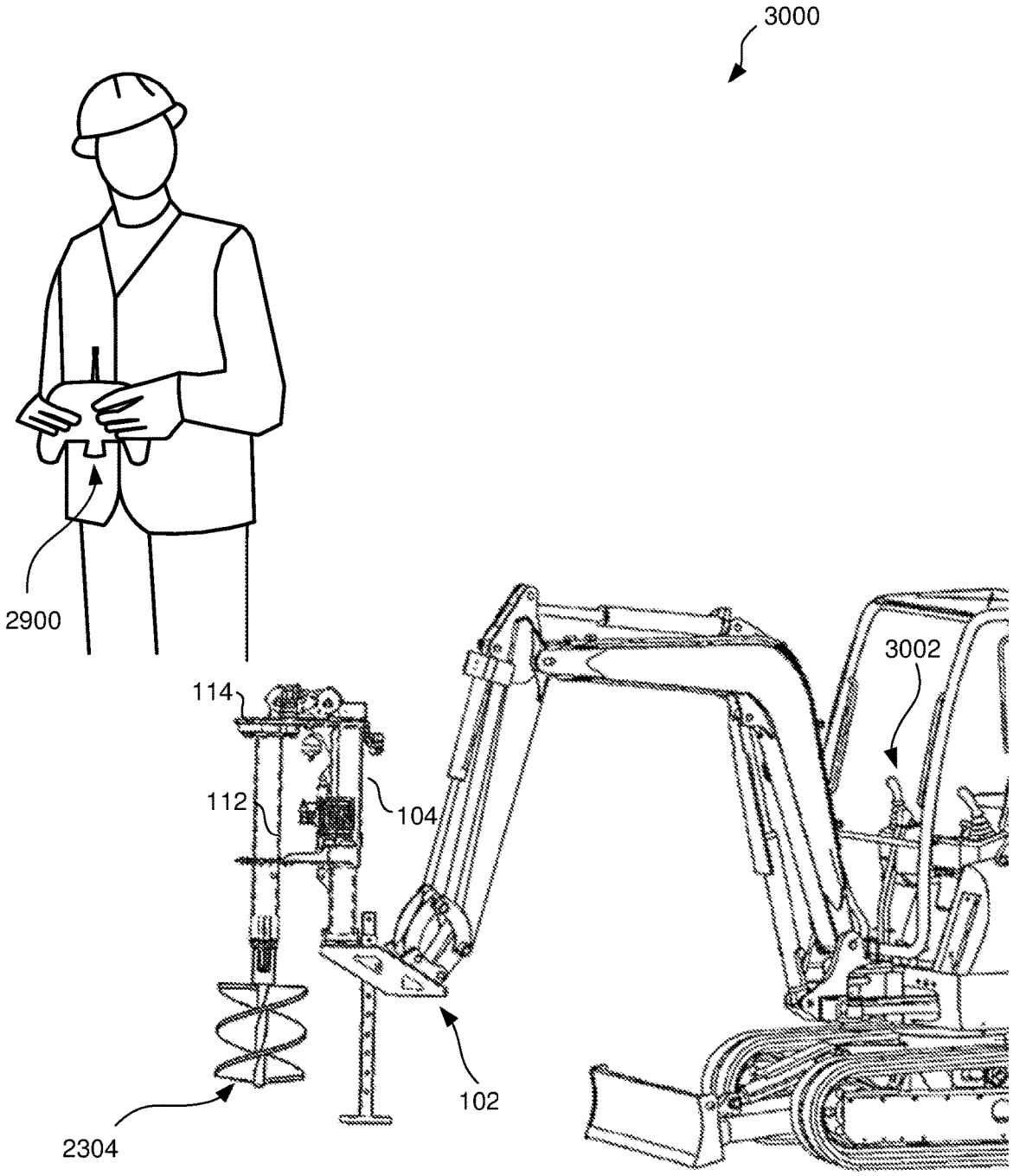
FIG. 30 illustrates a depiction of control of the quick disconnect Kelly bar system, in accordance with one embodiment.

FIG. 30 illustrates a depiction 3000 of control of the quick disconnect Kelly bar system, in accordance with one embodiment. As an option, the depiction 3000 may be implemented in the context of any one or more of the embodiments set forth in any previous and/or subsequent figure(s) and/or description thereof. Of course, however, the depiction 3000 may be implemented in the context of any desired environment. Further, the aforementioned definitions may equally apply to the description below.

As shown, the depiction 3000 includes the quick disconnect 102, the mast 104, the Kelly bar assembly 112, the headblock 114, the auger 2304, the depiction 2900 of a wireless controller, and a construction machine controller 3002 of an excavator. Operation of the construction attachment may occur by an operator located within the excavator, or may occur by an operator (as shown) located outside of the excavator. As discussed within the context of the depiction 2900, operation of the construction attachment may occur independent of the construction machine controller 3002 of the excavator.

It is to be appreciate that although an excavator is shown within the depiction 3000, as discussed herein, the construction attachment may be attached to any construction machine, and control of the construction attachment may occur independent of the construction machine. Additionally, as discussed above within the context of the depiction 2300, the depiction 3000 in like manner is not to scale.

Figure 31:
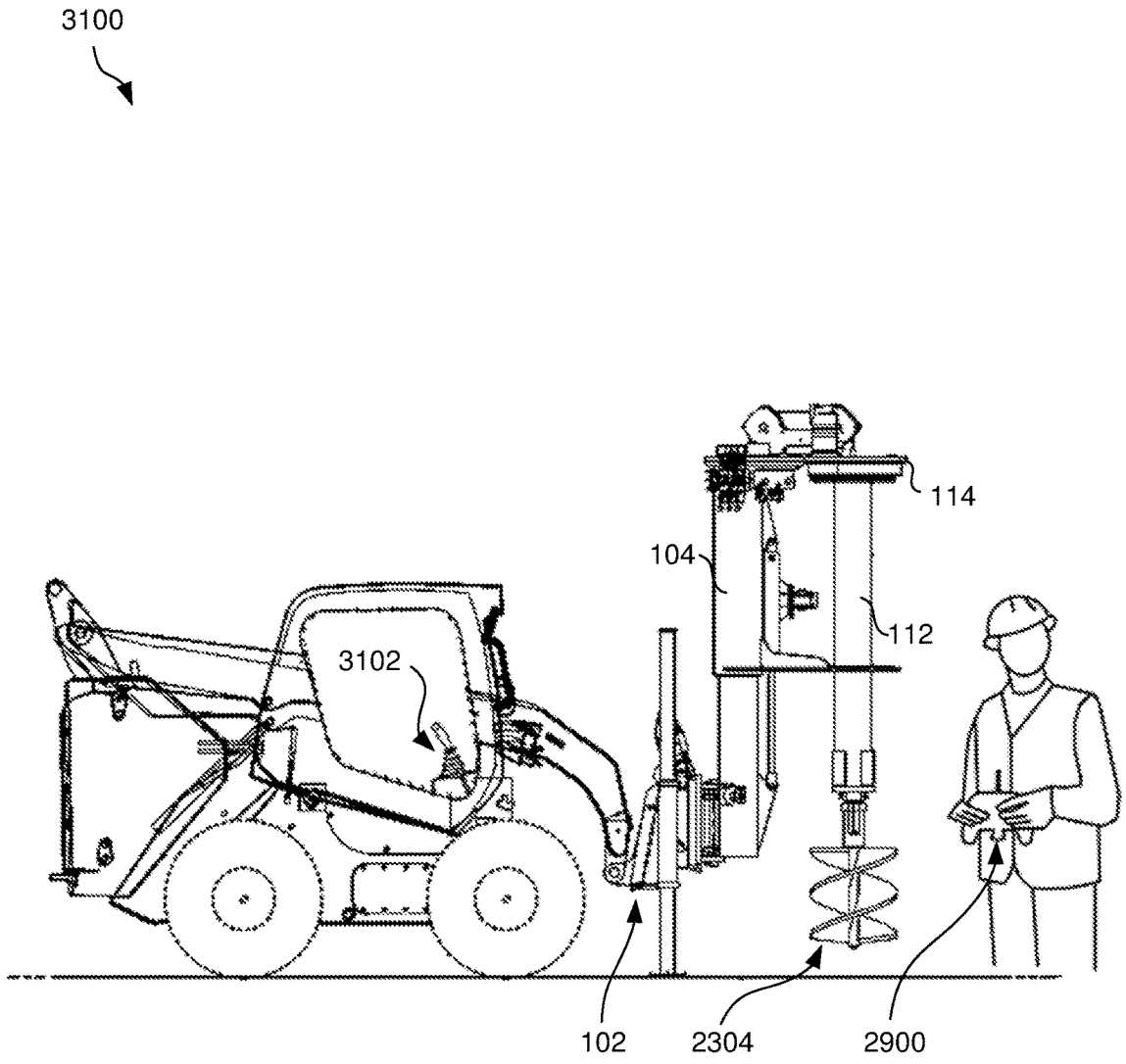
FIG. 31 illustrates another depiction of control of the quick disconnect Kelly bar system, in accordance with one embodiment.

FIG. 31 illustrates another depiction 3100 of control of the quick disconnect Kelly bar system, in accordance with one embodiment. As an option, the depiction 3100 may be implemented in the context of any one or more of the embodiments set forth in any previous and/or subsequent figure(s) and/or description thereof. Of course, however, the depiction 3100 may be implemented in the context of any desired environment. Further, the aforementioned definitions may equally apply to the description below.

As shown, the depiction 3100 includes the quick disconnect 102, the mast 104, the Kelly bar assembly 112, the headblock 114, the auger 2304, the depiction 2900 of a wireless controller, and a construction machine controller 3102 of a skid steer. Operation of the construction attachment may occur by an operator located within the skid steer, or may occur by an operator (as shown) located outside of the skid steer. As discussed within the context of the depiction 2900, operation of the construction attachment may occur independent of the construction machine controller 3102 of the skid steer.

It is to be appreciate that although a skid steer is shown within the depiction 3100, as discussed herein, the construction attachment may be attached to any construction machine, and control of the construction attachment may occur independent of the construction machine. Additionally, as discussed above within the context of the depiction 2300, the depiction 3100 in like manner is not to scale.

Figure 32:
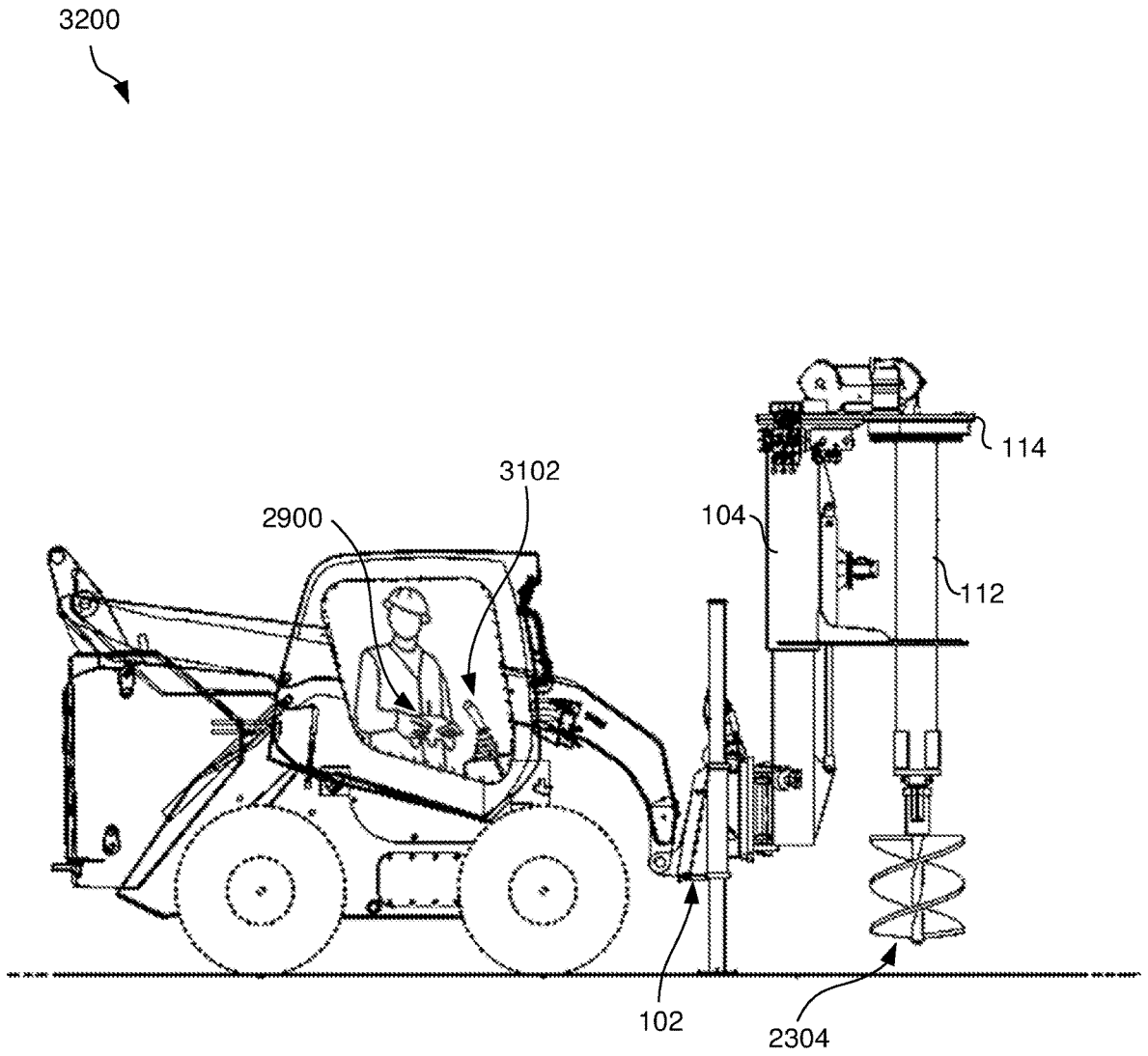
FIG. 32 illustrates another depiction of control of the quick disconnect Kelly bar system, in accordance with one embodiment.

FIG. 32 illustrates another depiction 3200 of control of the quick disconnect Kelly bar system, in accordance with one embodiment. As an option, the depiction 3200 may be implemented in the context of any one or more of the embodiments set forth in any previous and/or subsequent figure(s) and/or description thereof. Of course, however, the depiction 3200 may be implemented in the context of any desired environment. Further, the aforementioned definitions may equally apply to the description below.

As shown, the depiction 3200 includes the quick disconnect 102, the mast 104, the Kelly bar assembly 112, the headblock 114, the auger 2304, the depiction 2900 of a wireless controller, and a construction machine controller 3102 of a skid steer. Operation of the construction attachment may occur by an operator located within (as shown) the skid steer, or may occur by an operator located outside of the skid steer. As discussed within the context of the depiction 2900, operation of the construction attachment may occur independent of the construction machine controller 3102 of the skid steer.

It is to be appreciate that although a skid steer is shown within the depiction 3100, as discussed herein, the construction attachment may be attached to any construction machine, and control of the construction attachment may occur independent of the construction machine. Additionally, as discussed above within the context of the depiction 2300, the depiction 3200 in like manner is not to scale.

Figure 33:
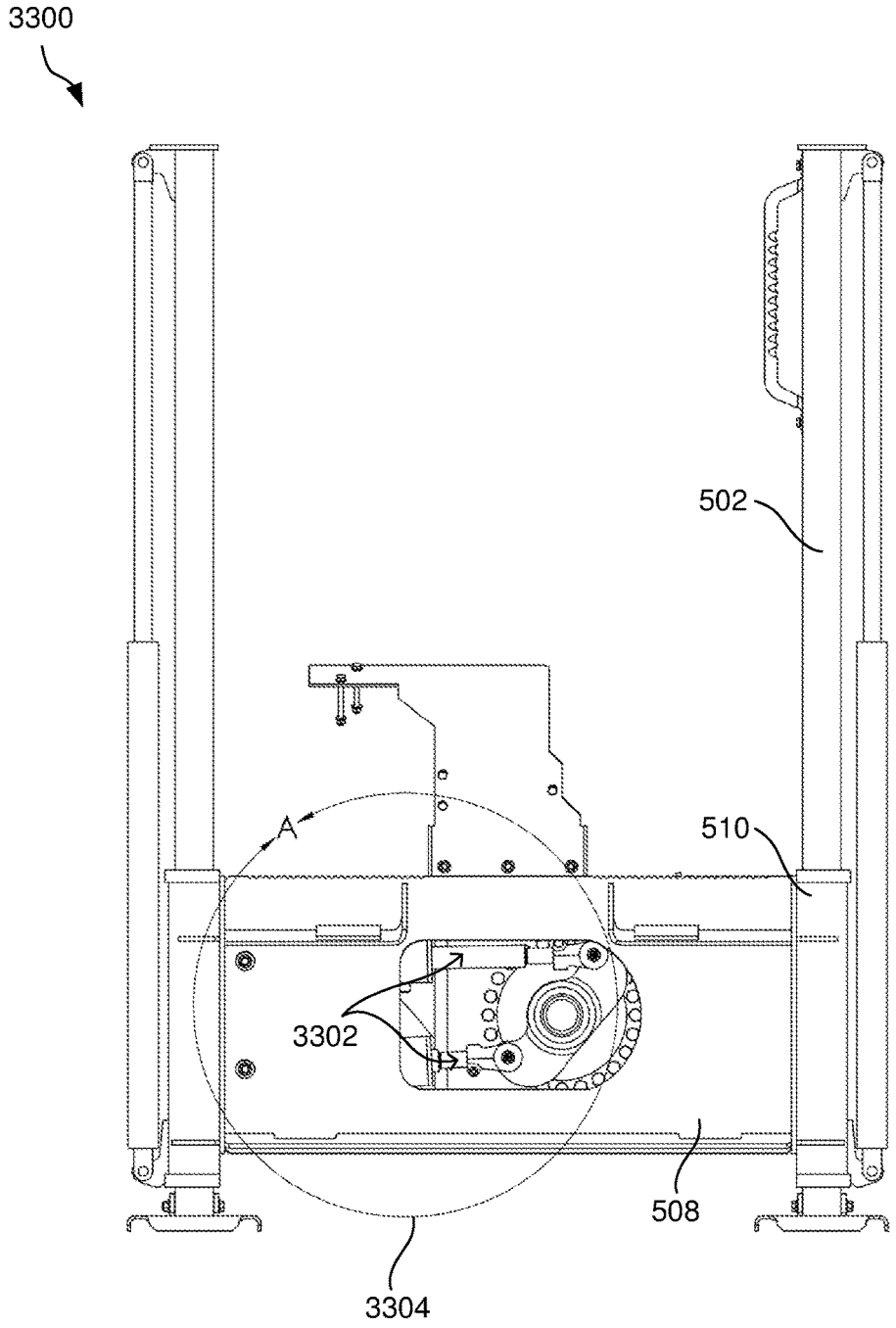
FIG. 33 illustrates a detailed view of an attachment frame of the quick disconnect Kelly bar system, in accordance with one embodiment.

FIG. 33 illustrates a detailed view 3300 of an attachment frame of the quick disconnect Kelly bar system, in accordance with one embodiment. As an option, the detailed view 3300 may be implemented in the context of any one or more of the embodiments set forth in any previous and/or subsequent figure(s) and/or description thereof. Of course, however, the detailed view 3300 may be implemented in the context of any desired environment. Further, the aforementioned definitions may equally apply to the description below.

As shown, the detailed view 3300 includes the one or more stabilizers 502 within the sleeves 510. Further, the attachment frame 508 may be configured for a quick disconnect. For example, the attachment frame 508 shows a universal quick disconnect for a skid steer. It is to be appreciated that the attachment frame 508 may be modified to account for any quick disconnect. Further, although the detailed view 3300 shows two stabilizers (the one or more stabilizers 502), it is to be understood that any number (or none) of stabilizers may be used, depending on the construction machine to which the attachment frame is connected.

Additionally, the detailed view 3300 shows a cylinder-based rotation system 3302. In one embodiment, the cylinder-based rotation system may function in place of the pivotable coupling assembly 602. In another embodiment, a portion of the pivotable coupling assembly 602 may be used in combination with the cylinder-based rotation system such that a pivoting mechanism may be provided which may be controlled by the cylinder-based rotation system 3302. In one embodiment, the cylinder-based rotation system 3302 may be used to rotate up to 360 degrees, as shown in angle 3304.

Figure 34:
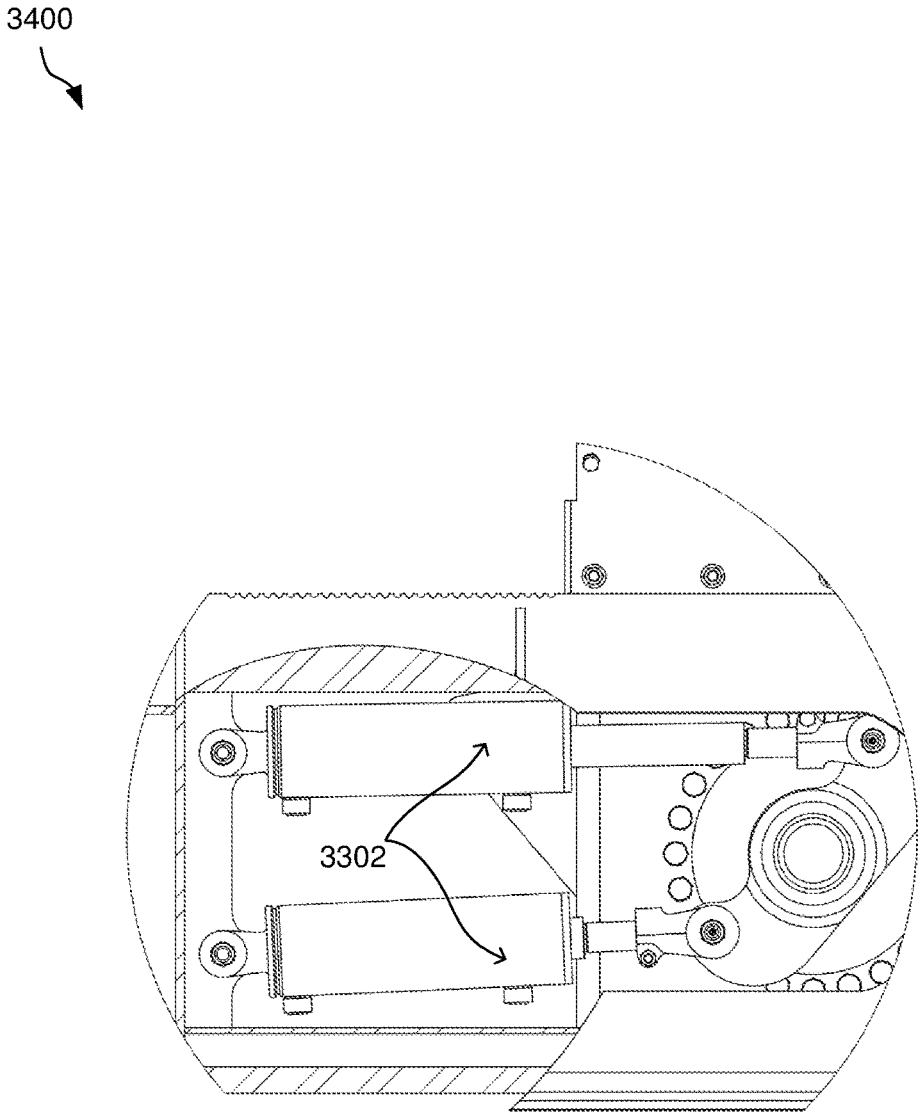
FIG. 34 illustrates a detailed view of the cylinder-based rotation system, in accordance with one embodiment.

FIG. 34 illustrates a detailed view 3400 of the cylinder-based rotation system, in accordance with one embodiment. As an option, the detailed view 3400 may be implemented in the context of any one or more of the embodiments set forth in any previous and/or subsequent figure(s) and/or description thereof. Of course, however, the detailed view 3400 may be implemented in the context of any desired environment. Further, the aforementioned definitions may equally apply to the description below.

The detailed view 3400 shows a zoomed-in perspective of the cylinder-based rotation system 3302. In one embodiment, the cylinder-based rotation system may function in place of the pivotable coupling assembly 602. In another embodiment, a portion of the pivotable coupling assembly 602 may be used in combination with the cylinder-based rotation system such that a pivoting mechanism may be provided which may be controlled by the cylinder-based rotation system 3302.

Figure 35:
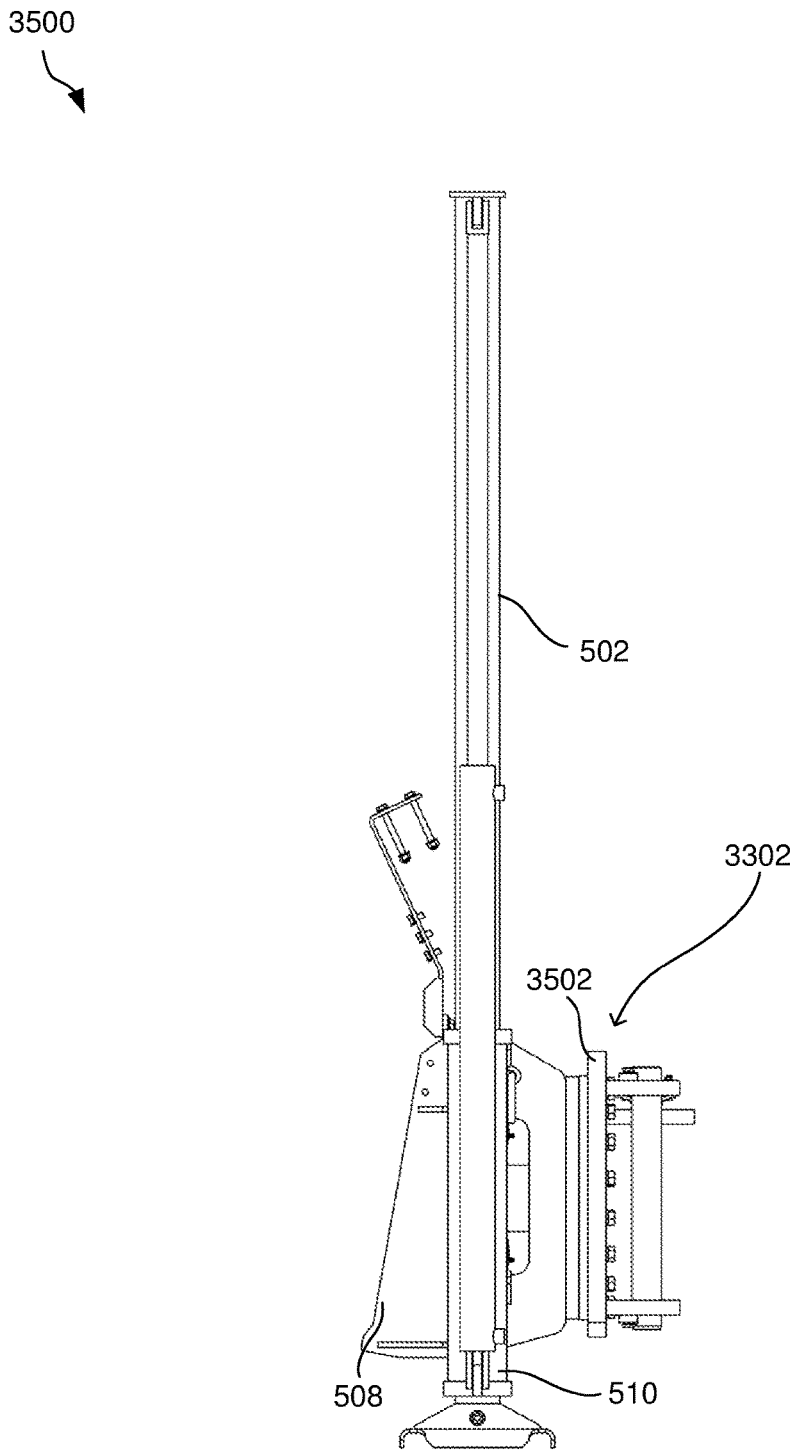
FIG. 35 illustrates a detailed view of an attachment frame of the quick disconnect Kelly bar system, in accordance with one embodiment.

FIG. 35 illustrates a detailed view 3500 of an attachment frame of the quick disconnect Kelly bar system, in accordance with one embodiment. As an option, the detailed view 3500 may be implemented in the context of any one or more of the embodiments set forth in any previous and/or subsequent figure(s) and/or description thereof. Of course, however, the detailed view 3300 may be implemented in the context of any desired environment. Further, the aforementioned definitions may equally apply to the description below.

As shown, the detailed view 3500 includes the one or more stabilizers 502 within the sleeves 510. Further, the attachment frame 508 may be configured for a quick disconnect. For example, the attachment frame 508 shows a universal quick disconnect for a skid steer. It is to be appreciated that the attachment frame 508 may be modified to account for any quick disconnect. Further, it is to be understood that any number (or none) of stabilizers may be used, depending on the construction machine to which the attachment frame is connected.

Additionally, the detailed view 3500 does not show the cylinder-based rotation system 3302, but it would be located to the side of the assembly 3502.

Figure 36:
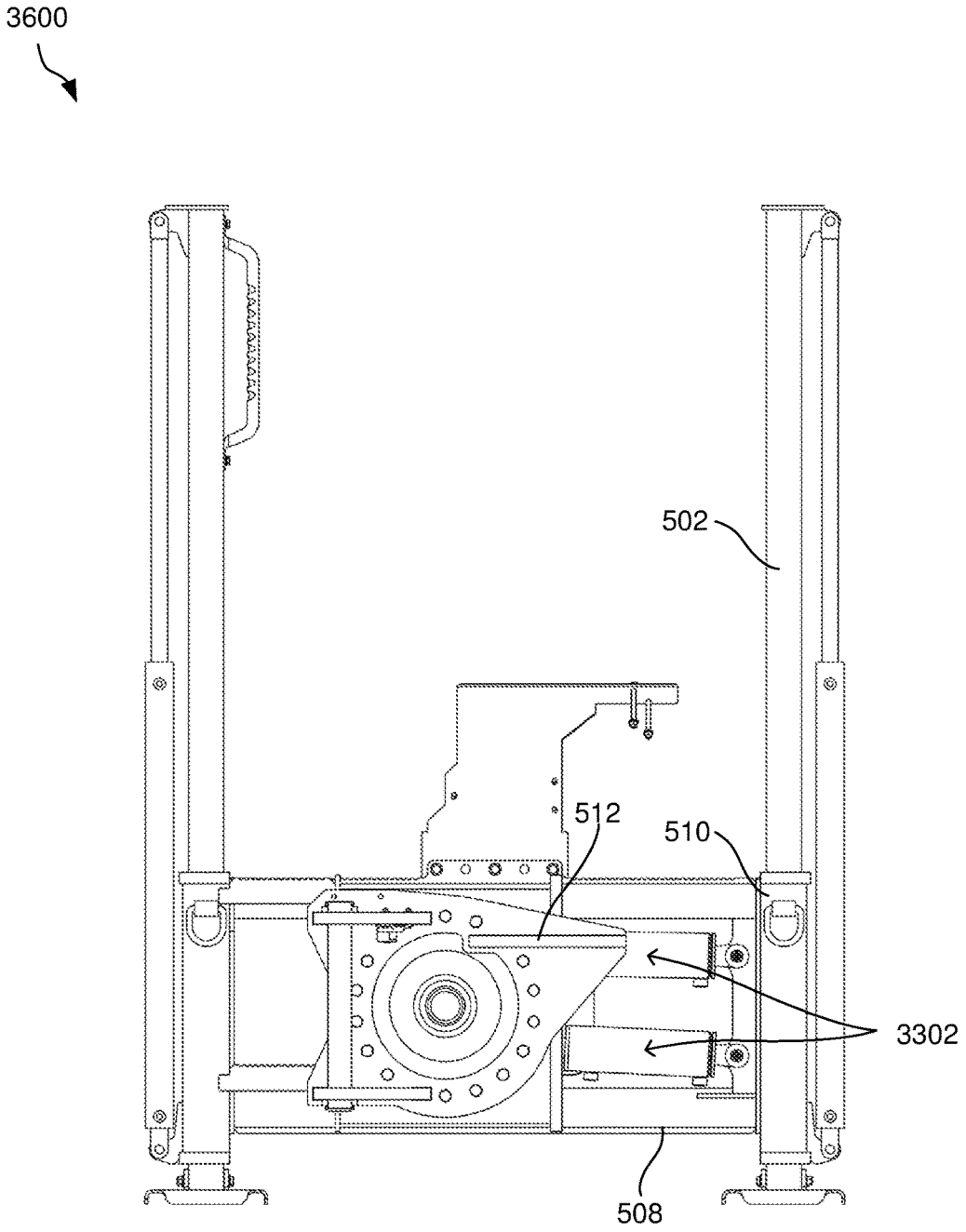
FIG. 36 illustrates a detailed view of an attachment frame of the quick disconnect Kelly bar system, in accordance with one embodiment.

FIG. 36 illustrates a detailed view 3600 of an attachment frame of the quick disconnect Kelly bar system, in accordance with one embodiment. As an option, the detailed view 3600 may be implemented in the context of any one or more of the embodiments set forth in any previous and/or subsequent figure(s) and/or description thereof. Of course, however, the detailed view 3600 may be implemented in the context of any desired environment. Further, the aforementioned definitions may equally apply to the description below.

As shown, the detailed view 3600 includes the one or more stabilizers 502 within the sleeves 510. Further, the attachment frame 508 may be configured for a quick disconnect. For example, the attachment frame 508 shows a universal quick disconnect for a skid steer. It is to be appreciated that the attachment frame 508 may be modified to account for any quick disconnect. Further, although the detailed view 3600 shows two stabilizers (the one or more stabilizers 502), it is to be understood that any number (or none) of stabilizers may be used, depending on the construction machine to which the attachment frame is connected. Further, the hinge portions 512 may be configured to attach to the mast 104 (and/or to a complimentary hinge portion of the mast 104).

Additionally, the detailed view 3600 shows a cylinder-based rotation system 3302. In one embodiment, the cylinder-based rotation system may function in place of the pivotable coupling assembly 602. In another embodiment, a portion of the pivotable coupling assembly 602 may be used in combination with the cylinder-based rotation system such that a pivoting mechanism may be provided which may be controlled by the cylinder-based rotation system 3302.

Figure 37:
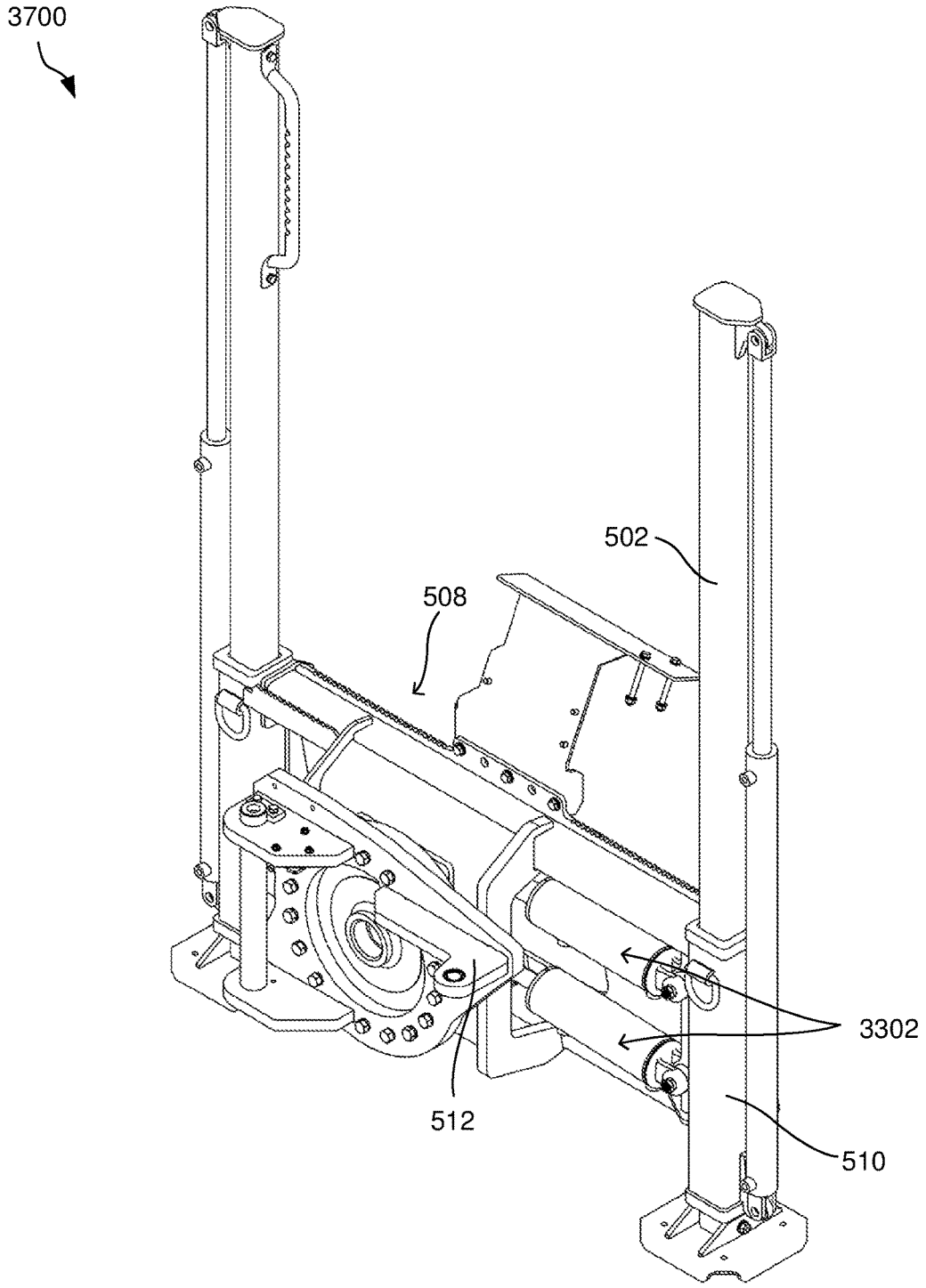
FIG. 37 illustrates a detailed view of an attachment frame of the quick disconnect Kelly bar system, in accordance with one embodiment.

FIG. 37 illustrates a detailed view 3700 of an attachment frame of the quick disconnect Kelly bar system, in accordance with one embodiment. As an option, the detailed view 3700 may be implemented in the context of any one or more of the embodiments set forth in any previous and/or subsequent figure(s) and/or description thereof. Of course, however, the detailed view 3700 may be implemented in the context of any desired environment. Further, the aforementioned definitions may equally apply to the description below.

As shown, the detailed view 3700 includes the one or more stabilizers 502 within the sleeves 510. Further, the attachment frame 508 (which is not shown face-on in the angel of the detailed view 3700) may be configured for a quick disconnect. Although the detailed view 3700 shows two stabilizers (the one or more stabilizers 502), it is to be understood that any number (or none) of stabilizers may be used, depending on the construction machine to which the attachment frame is connected. Further, the hinge portions 512 may be configured to attach to the mast 104 (and/or to a complimentary hinge portion of the mast 104).

Additionally, the detailed view 3700 shows a cylinder-based rotation system 3302. In one embodiment, the cylinder-based rotation system may function in place of the pivotable coupling assembly 602. In another embodiment, a portion of the pivotable coupling assembly 602 may be used in combination with the cylinder-based rotation system such that a pivoting mechanism may be provided which may be controlled by the cylinder-based rotation system 3302.

In various embodiments, a construction machine may have a minimum operating weight of 9,000 lb, where 50% of rated tipping load may be 3,200 lb, and 35% of rated tipping load may be 2,240 lb. In one embodiment, a hydraulic flow may be between 20 GPM and 30 GPM, and hydraulic pressure may be 3000 psi. Additionally, micro controllers and remote receivers (e.g. to communicate with the wireless controller) may be located on the headblock 114. Additionally, the headblock 114 may include main valve assembly relating to a rotate, a crowd, and/or the Kelly winch. Further, the headblock 114 may include a gearbox (for the Kelly bar assembly 112).

In various embodiments, the construction attachment may be installed onto a construction machine by aligning a hitch of the construction machine with the construction machine's quick disconnect mount. The construction machine may tilt the hitch forward until the top edge is below a flange on the quick disconnect mount. Once the flange is engage, forward travel on the construction machine may be stopped, and the construction machine hitch may be tilted back until the construction attachment clears the ground. Latch pins may be engaged (based on the construction machine's instruction). Once installed, the construction attachment's hydraulic lines may be connected to the construction machine's auxiliary hydraulics port. Of course, in other embodiments, connection of the hitch of the construction machine to the quick disconnect may involve other steps (depending on the type of hitch involved with the construction machine).

In various embodiments, the construction attachment may be removed from the construction machine by placing the construction in a stowed position, where a construction machine is swung forward until the attachment is a couple inches above the ground. The arms of the construction machine should be fully lowered. The auxiliary hydraulics may be disengaged and pressure released. The construction attachment may be titled back until it is slightly off the ground. The latch pins of the construction machine may be disengaged. The hitch of the construction machine may be tilted forward, and the construction machine may be backed away until the construction attachment is free from the construction machine.

In this manner, the construction attachment may be easily installed and removed from a construction machine.

As disclosed herein, the construction attachment overcomes many traditional problems within the industry. For example, drill controls are generally integrated into a carrier construction machine. The present construction attachment does not need to be integrated into the carrier construction machine, but can connect up hydraulics and electrical sources as needed. Additionally, the present construction attachment allows for telescoping Kelly bars (up to a drilling depth of 25 feet) without adding extensions (in contrast to conventional systems that use a dangle drill with extensions).

The present construction attachment allows for a crowd system that can be powered down without use of a boom of a construction machine. Additionally, use of an original equipment manufacturer (OEM) quick disconnect can be maintained, as emphasized throughout the present disclosure (with respect to the quick disconnect 102). Further, the present construction attachment allows for rapid mobilization, in that the construction attachment can be connected and disconnected from a construction machine for easy transport.

Still yet, the present construction allows for low-cost drills to be used for entry level drilling (without having to integrate drilling capabilities into a dedicated rig).

In various embodiments, the construction attachment may function as a true attachment (where it is not permanently integrated) with the construction machine. In one embodiment, a minimum size of a construction machine (that may use the construction attachment) may be 8 ton (such as a 8 ton compact excavator).

It should be understood that the arrangement of components illustrated in the Figures described are exemplary and that other arrangements are possible. It should also be understood that the various system components (and means) defined by the claims, described below, and illustrated in the various block diagrams represent logical components in some systems configured according to the subject matter disclosed herein. As such, embodiments of the present disclosure have been described in language more or less specific as to structural and methodical features. It is to be understood, however, that the entire disclosure is not limited to the specific features and/or embodiments shown and/or described.

For example, one or more of these system components (and means) may be realized, in whole or in part, by at least some of the components illustrated in the arrangements illustrated in the described Figures. In addition, while at least one of these components are implemented at least partially as an electronic hardware component, and therefore constitutes a machine, the other components may be implemented in software that when included in an execution environment constitutes a machine, hardware, or a combination of software and hardware.

More particularly, at least one component defined by the claims is implemented at least partially as an electronic hardware component, such as an instruction execution machine (e.g., a processor-based or processor-containing machine) and/or as specialized circuits or circuitry (e.g., discreet logic gates interconnected to perform a specialized function). Other components may be implemented in software, hardware, or a combination of software and hardware. Moreover, some or all of these other components may be combined, some may be omitted altogether, and additional components may be added while still achieving the functionality described herein. Thus, the subject matter described herein may be embodied in many different variations, and all such variations are contemplated to be within the scope of what is claimed.

In the description above, the subject matter is described with reference to acts and symbolic representations of operations that are performed by one or more devices, unless indicated otherwise. As such, it will be understood that such acts and operations, which are at times referred to as being computer-executed, include the manipulation by the processor of data in a structured form. This manipulation transforms the data or maintains it at locations in the memory system of the computer, which reconfigures or otherwise alters the operation of the device in a manner well understood by those skilled in the art. The data is maintained at physical locations of the memory as data structures that have particular properties defined by the format of the data. However, while the subject matter is being described in the foregoing context, it is not meant to be limiting as those of skill in the art will appreciate that various of the acts and operations described hereinafter may also be implemented in hardware.

To facilitate an understanding of the subject matter described herein, many aspects are described in terms of sequences of actions. At least one of these aspects defined by the claims is performed by an electronic hardware component. For example, it will be recognized that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

The embodiments described herein included the one or more modes known to the inventor for carrying out the claimed subject matter. Of course, variations of those embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. A construction attachment for a light construction machine, comprising:

a quick disconnect mounting plate for connecting the construction attachment to a hitch of the light construction machine;

a pivotable coupling assembly connected to the quick disconnect mounting plate;

an extendable mast connected to the pivotable coupling assembly at a first end of the extendable mast, and to a headblock structure at a second end of the extendable mast;

a Kelly-bar assembly connected to the headblock structure, and one or more motors attached to the headblock structure, wherein the one or more motors are used to control rotation of the Kelly-bar assembly;

wherein the headblock structure is rigidly attached to the extendable mast, and the Kelly-bar assembly extends from the headblock structure.

2. The construction attachment of claim 1, wherein the light construction machine includes a non-dedicated construction rig.

3. The construction attachment of claim 1, wherein the construction attachment is portable and can be removed from the light construction machine.

4. The construction attachment of claim 1, wherein the construction attachment is not integrated into the light construction machine, or the construction attachment is not a permanent attachment to the light construction machine.

5. The construction attachment of claim 1, wherein a function of the construction attachment is powered by the light construction machine.

6. The construction attachment of claim 1, wherein a control of the construction attachment occurs by at least one of a wired or a wireless connection.

7. The construction attachment of claim 1, wherein an earth penetrating device or an auger is connected to the Kelly-bar assembly.

8. The construction attachment of claim 1, wherein the extendable mast and the Kelly-bar assembly are configured for transport by aligning the extendable mast and the Kelly-bar assembly in a substantially horizontal relationship in relation to ground.

9. The construction attachment of claim 1, wherein the quick disconnect mounting plate includes one or more sleeves located on a lateral edge of the quick disconnect mounting plate.

10. The construction attachment of claim 9, wherein the one or more sleeves are configured to slidably engage one or more stabilizers, wherein the one or more stabilizers are controlled by at least one hydraulic piston attached to the quick disconnect mounting plate or mechanically attached to the quick disconnect mounting plate.

11. The construction attachment of claim 1, wherein the Kelly-bar assembly is connected to an auger, and is extended at an angle perpendicular to a substrate surface.

12. The construction attachment of claim 1, wherein the Kelly-bar assembly is connected to an auger, and is extended at an angle other than perpendicular to a substrate surface.

13. The construction attachment of claim 1, wherein the pivotable coupling is operable to pivot the extendable mast, the headblock, and the Kelly-bar assembly between a horizontal position and a vertical position.

14. The construction attachment of claim 1, wherein the extendable mast is operable to swing between a first position wherein the extendable mast and the Kelly-bar assembly face the quick disconnect mounting plate, and a second position wherein the extendable mast is situated between the Kelly-bar assembly and the quick disconnect mounting plate.

15. The construction attachment of claim 1, further comprising a Kelly winch attached to the extendable mast, wherein the Kelly winch includes a winch drum for wire rope, the wire rope extending from the Kelly winch over the headblock structure and connected to the Kelly-bar assembly.

16. The construction attachment of claim 1, further comprising at least one of:

at least one first piston attached to a first segment of the extendable mast and a second segment of the extendable mast, wherein the at least one first piston is used to control a height of the extendable mast;

at least one second piston attached to the quick disconnect mounting plate and to the first segment of the extendable mast, wherein the at least one second piston is used to control an angle of the extendable mast; or one or more motors attached to the headblock structure, wherein the one or more motors are used to control pivoting of the Kelly-bar assembly away from the extendable mast.

17. The construction attachment of claim 1, wherein at least one of:

the light construction machine includes a skid steer or a compact excavator, the quick disconnect mounting plate is configured to be compatible with a universal skid steer hitch, or the quick disconnect mounting plate is configured to be compatible with an excavator quick coupler.

18. The construction attachment of claim 1, wherein:

wherein the construction attachment is configured to be powdered down without use of a boom of the light construction machine, a control of the construction attachment occurs independent of the light construction machine, and the control is dependent on a connection of auxiliary pressure and auxiliary power lines connected from the light construction machine to the construction attachment, the one or more motors are used to control pivoting of the Kelly-bar assembly away from the extendable mast, or the construction attachment is configured to provide a drilling depth that is greater than a height of the light construction machine and the construction attachment combined.

19. The construction attachment of claim 1, wherein the extendible and the Kelly-bar assembly are configured to rotate on an axis of a boom of the light construction machine.

* * * * *